US009216134B2

(12) United States Patent
Inada et al.

(10) Patent No.: US 9,216,134 B2
(45) Date of Patent: Dec. 22, 2015

(54) MASSAGE MACHINE

(75) Inventors: Nichimu Inada, Osaka (JP); Hideshi Kondo, Osaka (JP); Yoshifumi Fukuyama, Tottori (JP); Nagatoshi Harada, Osaka (JP); Hiroo Hujita, Osaka (JP); Yoshiyuki Hamada, Osaka (JP); Yasuhiro Sugino, Osaka (JP); Myongsik Kim, Osaka (JP); Mitsuo Deguchi, Osaka (JP)

(73) Assignee: Family Inada Co., Ltd., Osaka (JP)

( * ) Notice: Subject to any disclaimer, the term of this patent is extended or adjusted under 35 U.S.C. 154(b) by 1066 days.

(21) Appl. No.: 13/321,763

(22) PCT Filed: May 12, 2010

(86) PCT No.: PCT/JP2010/003217

§ 371 (c)(1),
(2), (4) Date: Nov. 21, 2011

(87) PCT Pub. No.: WO2010/134293

PCT Pub. Date: Nov. 25, 2010

(65) Prior Publication Data

US 2012/0071799 A1 Mar. 22, 2012

(30) Foreign Application Priority Data

May 21, 2009 (JP) ..... 2009-123291
Aug. 11, 2009 (JP) ..... 2009-186823

(51) Int. Cl.

| | |
|---|---|
| ***A61H 7/00*** | (2006.01) |
| ***A61H 9/00*** | (2006.01) |
| *A61H 23/02* | (2006.01) |
| *A61H 15/00* | (2006.01) |

(52) U.S. Cl.

CPC ..... *A61H 9/0078* (2013.01); *A61H 7/004* (2013.01); *A61H 23/0263* (2013.01); (Continued)

(58) Field of Classification Search

CPC ..... A61H 7/00; A61H 7/002; A61H 7/003; A61H 7/004; A61H 7/005; A61H 7/007; A61H 2007/009; A61H 2201/1418; A61H 2201/1427; A61H 2201/1635; A61H 2201/164; A61H 2201/1645; A61H 2015/0007; A61H 2015/0014; A61H 2015/0042; A61H 15/0028; A61H 2201/0138; A61H 2201/12; A61H 2201/1207; A61H 2201/1215; A61H 2201/1223; A61H 2201/123; A61H 2201/1238; A61H 2201/1661; A61H 2201/1664; A61H 2201/1669; A61H 2201/169; A61H 2201/1692

USPC ..... 601/97, 98, 100, 101, 103, 104, 133, 601/134, 136, 138

See application file for complete search history.

(56) References Cited

U.S. PATENT DOCUMENTS 6,599,261 B1 7/2003 Chen
6,969,361 B2 * 11/2005 Hsieh ..... 601/127

(Continued)

FOREIGN PATENT DOCUMENTS

JP 2005-21645 A 1/2005
JP 2005-34174 A 2/2005

(Continued)

*Primary Examiner* — Justine Yu
*Assistant Examiner* — Michael Tsai
(74) *Attorney, Agent, or Firm* — Michael Best & Friedrich LLP

(57) ABSTRACT

Provided is a massage machine capable of performing a rubbing operation and a pressing operation separately on different areas of the back surface of a body part of a person to be treated while performing the rubbing operation on the side surface of the body part. Specifically provided is a massage machine (M1 (M2)) provided with a rubbing unit (1) comprising a pair of rubbing parts (2, 2) for applying a rubbing massage to a body part of a person to be treated and a rubbing driving part (3) for driving the rubbing parts (2). The rubbing parts (2) comprise a pair of first rubbing parts (12, 12) disposed on both sides of the body part and reciprocating in the direction along the side surface of the body part, and a pair of second rubbing parts (13, 13) disposed on the back surface of the body part and reciprocating in the direction along the back surface of the body part and in the direction crossing the back surface.

15 Claims, 27 Drawing Sheets

(52) U.S. Cl.
CPC ..... *A61H 2015/0014* (2013.01); *A61H 2201/0149* (2013.01); *A61H 2201/1669* (2013.01); *A61H 2201/5007* (2013.01); *A61H 2201/5071* (2013.01); *A61H 2205/10* (2013.01); *A61H 2230/00* (2013.01)

(56) References Cited

U.S. PATENT DOCUMENTS 7,041,070 B2 * 5/2006 Hsieh ..... 601/90
7,147,611 B2 12/2006 Kassel et al.
7,179,239 B2 * 2/2007 Chang ..... 601/90

FOREIGN PATENT DOCUMENTS

JP 2008-80094 A 4/2008
JP 2008-245968 A 10/2008

* cited by examiner

FIG.10
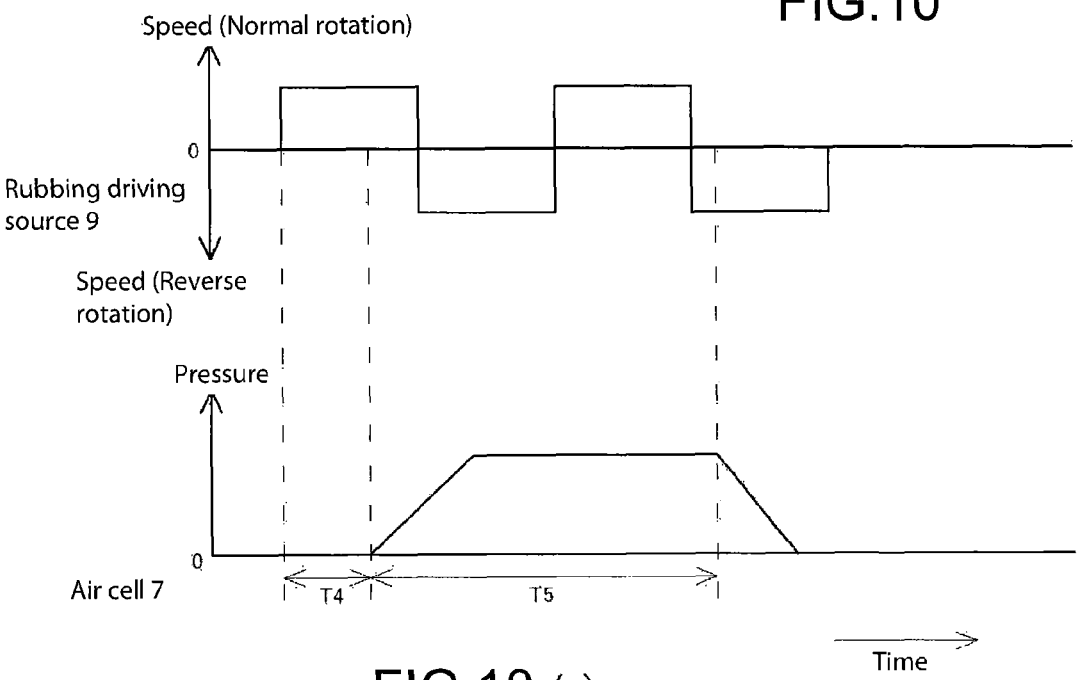
FIG.10 (a)
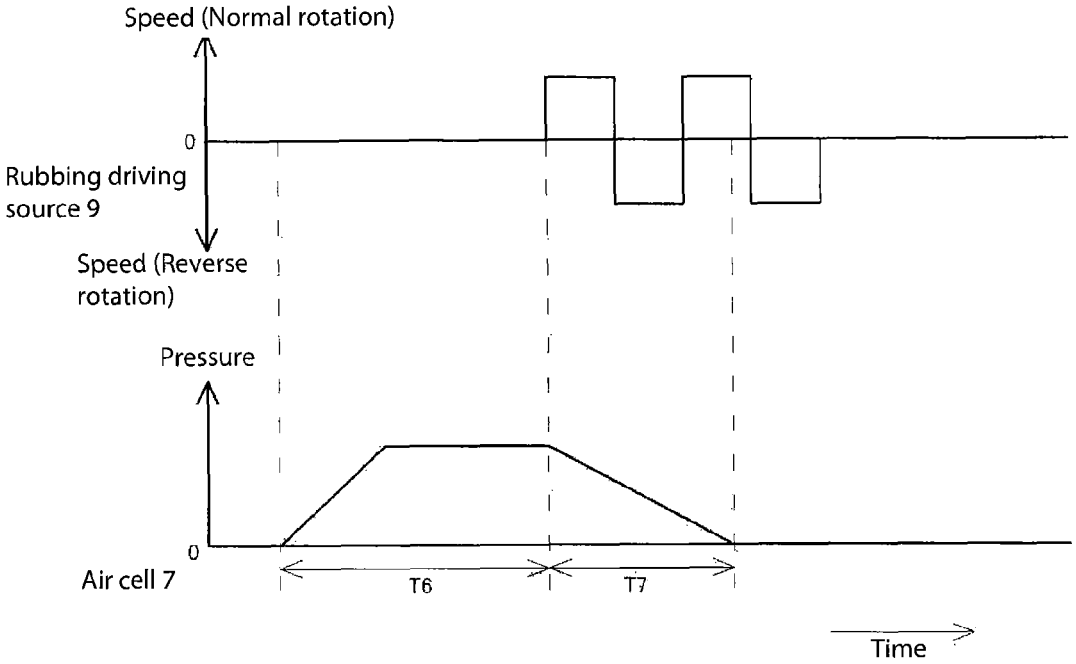
FIG.10 (b)

FIG.12
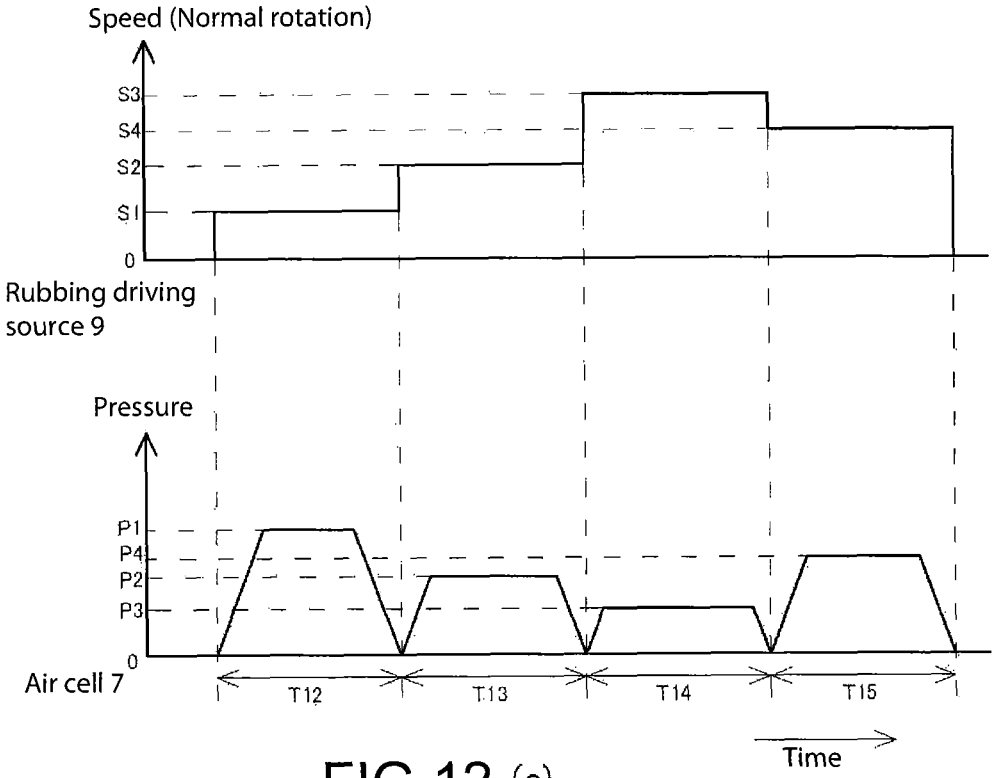
FIG.12 (a)
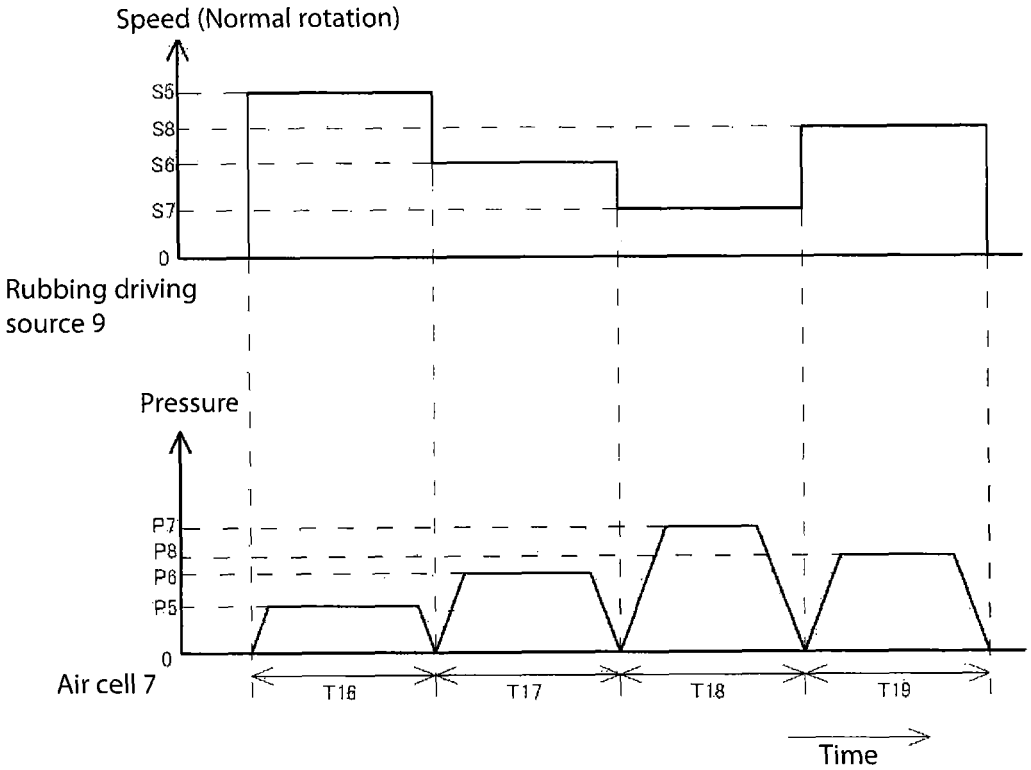
FIG.12 (b)

FIG.20
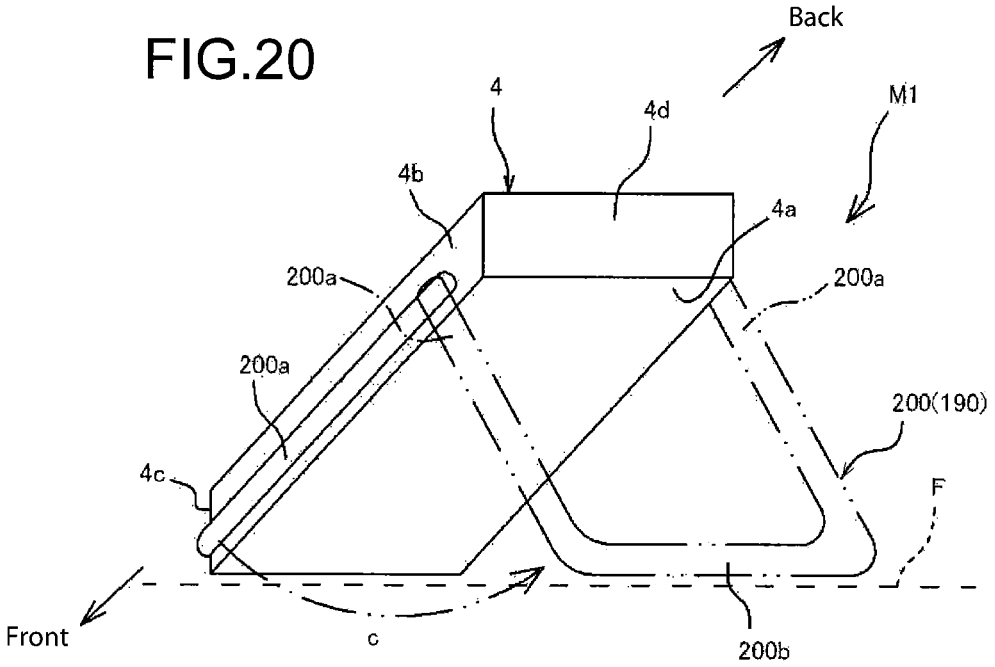
FIG.20 (a)
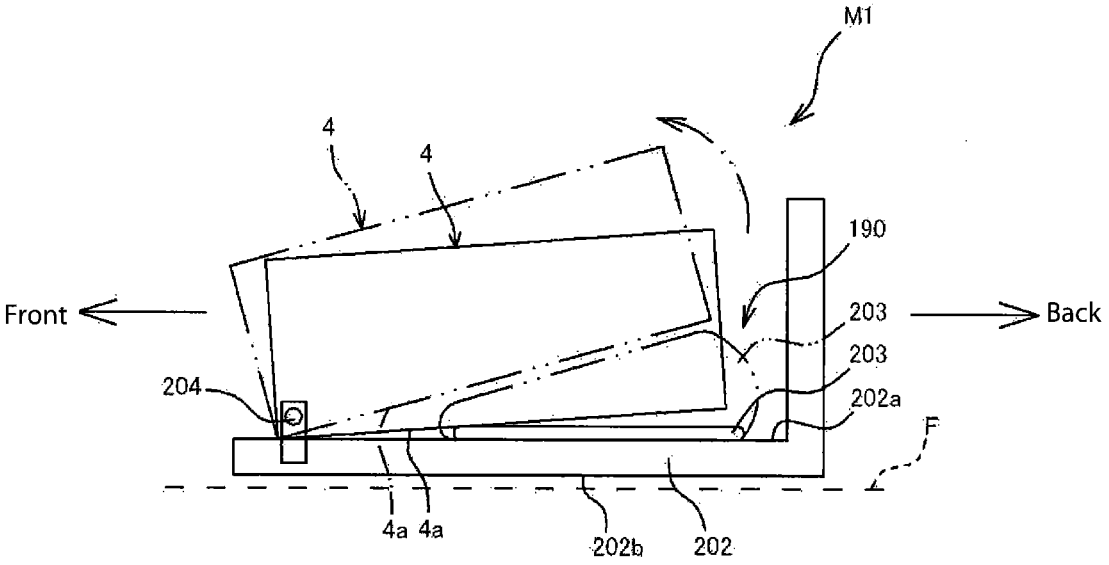
FIG.20 (b)

FIG.25
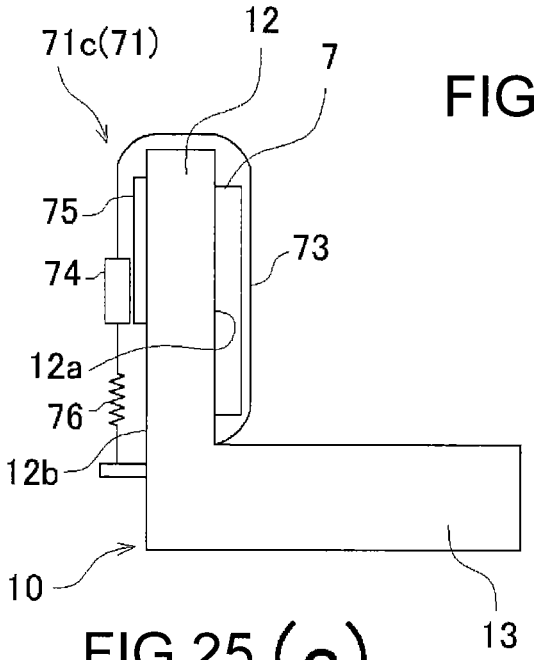
FIG.25 (a)
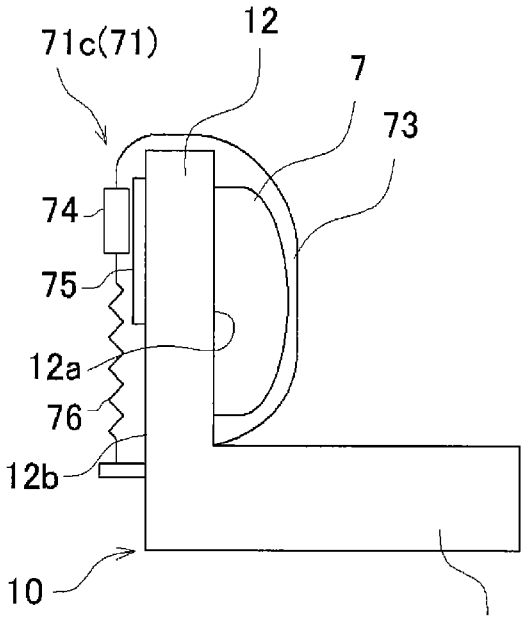
FIG.25 (b)

MASSAGE MACHINE

TECHNICAL FIELD

The present invention relates to a massage machine provided with a rubbing unit including a rubbing part which performs a rubbing massage on a body part of a person to be treated, and a rubbing driving part which drives the rubbing part.

BACKGROUND ART

Conventionally, a massage machine which rubs a body part of a person to be treated has been known. One example of such a massage machine is configured such that a pair of treatment boards arranged on both sides of a body part of a person to be treated so as to interpose the body part is made to reciprocate along the side surfaces of the body part to perform a rubbing action on the side surfaces of the body part while a back treatment board disposed between the pair of treatment boards and arranged to the back of the body part is made to reciprocate in the vertical and the front-back directions to perform a rubbing action and a pressing action on the back surfaces of the body part (see PTL 1, for example).

CITATION LIST

Patent Document

[PTL 1] JP-A-2008-245968

SUMMARY OF INVENTION

Technical Problem

According to the massage machine disclosed in above PTL 1, however, while it is possible to perform a rubbing action on the side surfaces of the body part and a rubbing action and a pressing action on the back surface of the body part, it is not possible to individually press different parts on the back surface of the body part.

Thus, the present invention was made to solve the above problem, and the object thereof is to provide a massage machine capable of individually performing a rubbing action and a pressing action on different parts on the back surface of a body part of a person to be treated while performing a rubbing action on the side surfaces of the body part.

Solution to Problem

The present invention provides a massage machine characterized by including: a rubbing unit including a pair of rubbing parts which performs rubbing massage on a body part of a person to be treated and a rubbing driving unit which drives the rubbing part, wherein the rubbing parts include a pair of first rubbing parts which is arranged on both sides of the body part and reciprocated in a direction along a side surface of the body part and a pair of left and right second rubbing parts which is arranged between the pair of first rubbing parts on the back surface of the body part and reciprocated in a direction along the back surface of the body part and in a direction perpendicular to the back surface.

With such a configuration, it is possible to rub the side surfaces of the body part by the pair of first rubbing parts and individually rub and press different portions in the back surface of the body parts by the pair of second rubbing part.

In addition, the present invention provides a massage machine characterized by including: a rubbing unit including a pair of rubbing parts which performs rubbing massage on a body part of a person to be treated and a rubbing driving unit which drives the rubbing parts, wherein the rubbing parts include a pair of external rubbing parts and an intermediate rubbing part arranged between the pair of external rubbing parts, wherein the external rubbing parts and the intermediate rubbing part include a first rubbing part which is arranged on a side of the body part and reciprocated in a direction along a side surface of the body part and a second rubbing part which is reciprocated in a direction along the back surface of the body part and in a direction perpendicular to the back surface.

With such a configuration, it is possible to rub both side surfaces of both legs with the first rubbing part included in the pair of external rubbing part and the first rubbing part included in the intermediate rubbing part and individually rub and press different portions in the back surfaces of both legs with the second rubbing part included in the pair of external rubbing part and the second rubbing part included in the intermediate rubbing part.

In addition, it is preferable that the first rubbing part and the second rubbing part are integrally configured.

With such a configuration, it is possible to drive both the first rubbing part and the second rubbing part only by transmitting the power of the rubbing driving unit to any one of the first rubbing part and the second rubbing part and drive the first rubbing part and the second rubbing part in a conjunction manner. Accordingly, it is not necessary to provide a transmission part or the like which drives the first rubbing part and the second rubbing part in a conjunction manner and thereby to simplify the configuration.

In addition, it is preferable that the pair of rubbing parts is reciprocated in mutually different phases.

With such a configuration, since the pair of first rubbing parts is reciprocated in mutually different phases, it is difficult for the body part to be displaced together in a direction along the side surfaces of the body part. Accordingly, positional deviation in the direction along the side surfaces of the body part occurs between the first rubbing part and the body part during the reciprocating action of the first rubbing part, and it is possible to appropriately rub the side surfaces of the body part. Moreover, since the pair of second rubbing parts is reciprocated in mutually different phases, the portions which are different in the left and the right sides in the back surface of the body part are pressed (vertical movement) at different timing, and it is possible to twist the body part in the horizontal direction.

In addition, it is preferable that the external rubbing parts and the intermediate rubbing part are reciprocated in mutually different phases.

With such a configuration, since first rubbing part included in the pair of external rubbing parts and the first rubbing part included in the intermediate rubbing part are reciprocated in mutually different phases, it is difficult for both legs to be displaced together in a direction along the side surfaces of the legs. Accordingly, positional deviation in the direction along the side surfaces of the legs occurs between the first rubbing part and the body part during the reciprocating action of the first rubbing part, and it is possible to appropriately rub the side surfaces of both legs. Moreover, since the second rubbing part included in the pair of external rubbing parts and the second rubbing part included in the intermediate rubbing part are reciprocated in mutually different phases, the portions which are different in the left and the right sides in the back surfaces of the legs are pressed (vertical movement) at different timing, and it is possible to twist both legs in the horizontal direction.

In addition, it is preferable that the rubbing parts include a massage part which is arranged in the inner surface of the first rubbing part to perform a massage on the body part.

With such a configuration, it is possible to perform the massage by the massage unit as well as the rubbing actions by the first rubbing parts and the second rubbing part.

In addition, it is preferable that the massage part is an air cell which expands and contracts by supply and discharge of air so as to press the body part.

With such a configuration, it is possible to easily adjust the interval between the pair of rubbing parts or the interval between the external rubbing parts and the intermediate rubbing part in accordance with the size and the shape of the body part. Moreover, it is possible to perform pressing massage on the body part by the expansion and the contraction of the air cell as well as the rubbing action.

It is preferable that the air cell expands and contracts during reciprocation of the rubbing part.

With such a configuration, it is possible to maintain the interval between the pair of rubbing parts or the interval between the external rubbing parts and the intermediate rubbing part in a state corresponding to the shape of the body part by appropriately adjusting the degree of the expansion of the air cell even if the positional relationship between the rubbing part and the body part is changed during the reciprocation of the rubbing part.

In addition, it is preferable that a plurality of air cells are provided in a direction along the body part.

With such a configuration, it is possible to more appropriately allow the interval between the pair of rubbing parts or the interval between the external rubbing parts and the intermediate rubbing part to substantially coincide with the shape of the body part. For example, it is possible to allow the interval between the pair of rubbing parts or the interval between the external rubbing parts and the intermediate rubbing part to substantially coincide with the shape of the leg by expanding the air cell located on the side of the calf so as to be larger than the air cell located on the side of the ankle when the body part to be massaged is legs.

In addition, it is preferable that the massage machine further includes a base part which supports the rubbing unit, wherein the base part includes a restriction part which restricts a movement of the rubbing part in a direction perpendicular to the side surface of the body part.

With such a configuration, it is possible to prevent the interval between the pair of rubbing parts or the interval between the external rubbing parts and the intermediate rubbing part from being unnecessarily increased due to the reaction force by the expansion of the air cell.

Advantageous Effects of Invention

According to the present invention, it is possible to provide a massage machine capable of individually performing a rubbing operation and a pressing operation on different parts on the back surface of a body part of a person to be treated while performing a rubbing operation on the side surfaces of the body part.

BRIEF DESCRIPTION OF DRAWINGS

FIG. 8(*b*) is a front view of the massage machine, which schematically shows a state in which one end of the external rubbing part in the front-back direction is at the highest position while the other end of the intermediate rubbing part in the front-back direction is at the lowest position.

FIG. 10(*a*) is an action explanatory diagram of the rubbing driving source and the air cell in a treatment pattern 2. FIG. 10(*b*) is an action explanatory diagram of the rubbing driving source and the air cell in a treatment pattern 3.

FIG. 12(*a*) is an action explanatory diagram of the rubbing driving source and the air cell in a treatment pattern 5. FIG. 12(*b*) is an action explanatory diagram of the rubbing driving source and the air cell in a treatment pattern 6.

FIG. 20(*a*) is a back perspective view of the massage machine for illustrating an example of an angle adjustment mechanism. FIG. 20(*b*) is a left side view of the massage machine for illustrating another example of the angle adjustment mechanism.

FIG. 25(*a*) is a front view schematically showing en external rubbing part of the massage machine in a state in which the air cell is contracted, which illustrates the configuration of the detection part according to the third embodiment included in the strength adjustment part (version 1). FIG. 25(*b*) is a front view schematically showing the external rubbing part of the massage machine in a state in which the air cell is expanded, which illustrates the configuration of the detection part according to the third embodiment included in the strength adjustment part (version 1).

DESCRIPTION OF EMBODIMENTS

Overall Configuration

Figure 1:
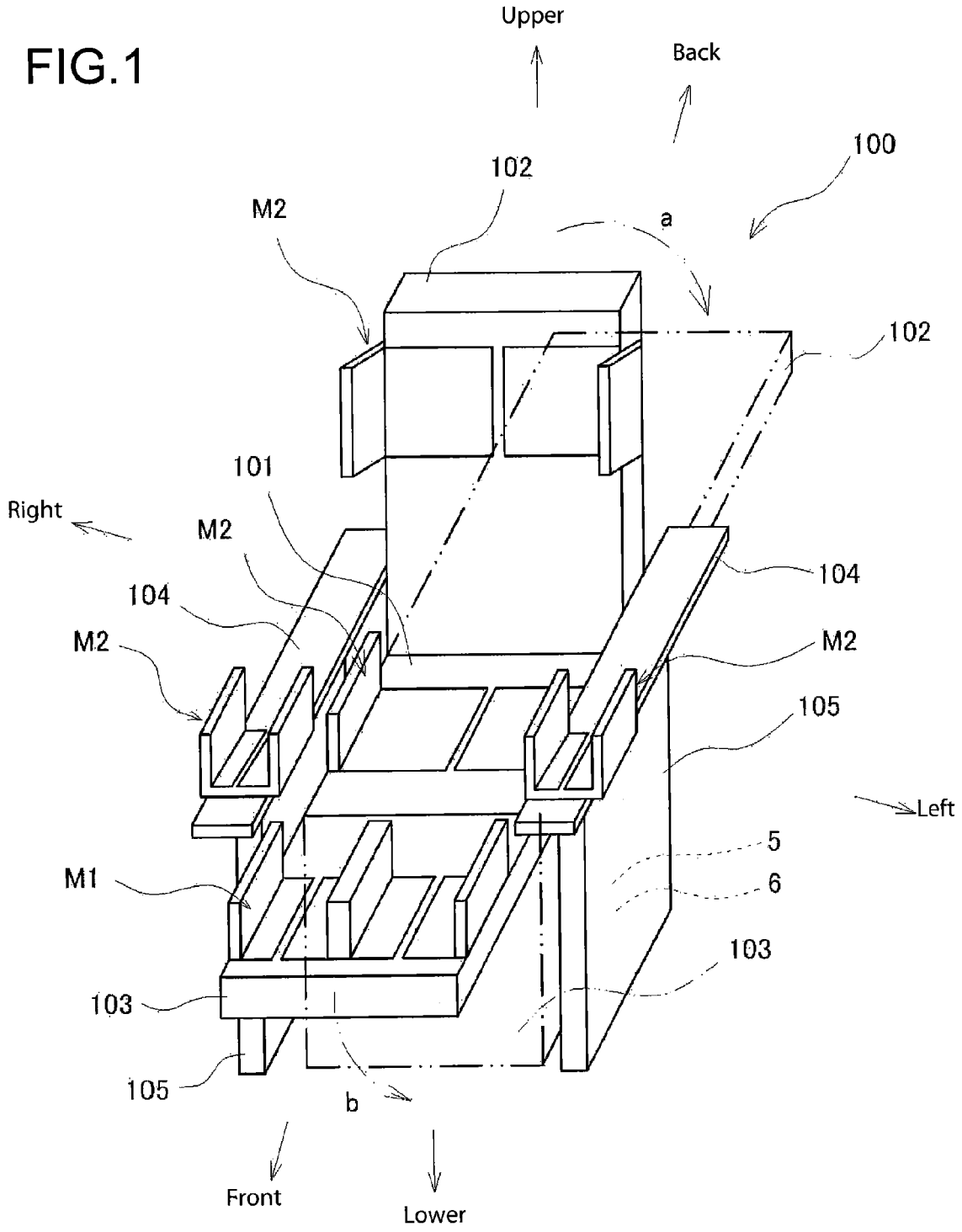
FIG. 1 is a front perspective view of a chair type massage machine provided with massage machines according to the first and second embodiments of the present invention.

Hereinafter, description will be made of the overall configuration of a chair type massage machine 100 provided with massage machines M1 and M2 according to the first and second embodiments of the present invention with reference to FIGS. 1 and 2. FIG. 1 is a front perspective view of the chair type massage machine provided with massage machines according to the first and second embodiments of the present invention, and FIG. 2 is a functional block diagram of the chair type massage machine shown in FIG. 1.

As shown in FIG. 1, the chair type massage machine 100 provided with the massage machine M1 according to the first embodiment of the present invention and the massage machine M2 according to the second embodiment of the present invention includes a seat part 101 on which a person to be treated sits, a backrest part 102 which is rotatably coupled to the back side of the seat part 101 in the front-back direction (the direction of an arrow a), a foot rest part 103 which is rotatably coupled to the front side of the seat part 101 in the front-back direction (the direction of an arrow b), armrest parts 104 and 104 provided on both the left and right sides of the seat part 101, and supporting leg parts 105 and 105 extended downward from the armrest parts 104 and 104 and placed on the floor. As for the concept of the directions in this specification, the front side is "front", the back side is "back", the left side is "left", the right side is "right", the head side is "upper", and the lower back side is "lower" when a person to be treated who is seated on the chair type massage machine 100 in the state in which the back rest part 102 is made to stand and the foot rest 103 is made to be raised up to a substantially horizontal state faces the front side.

Figure 2:
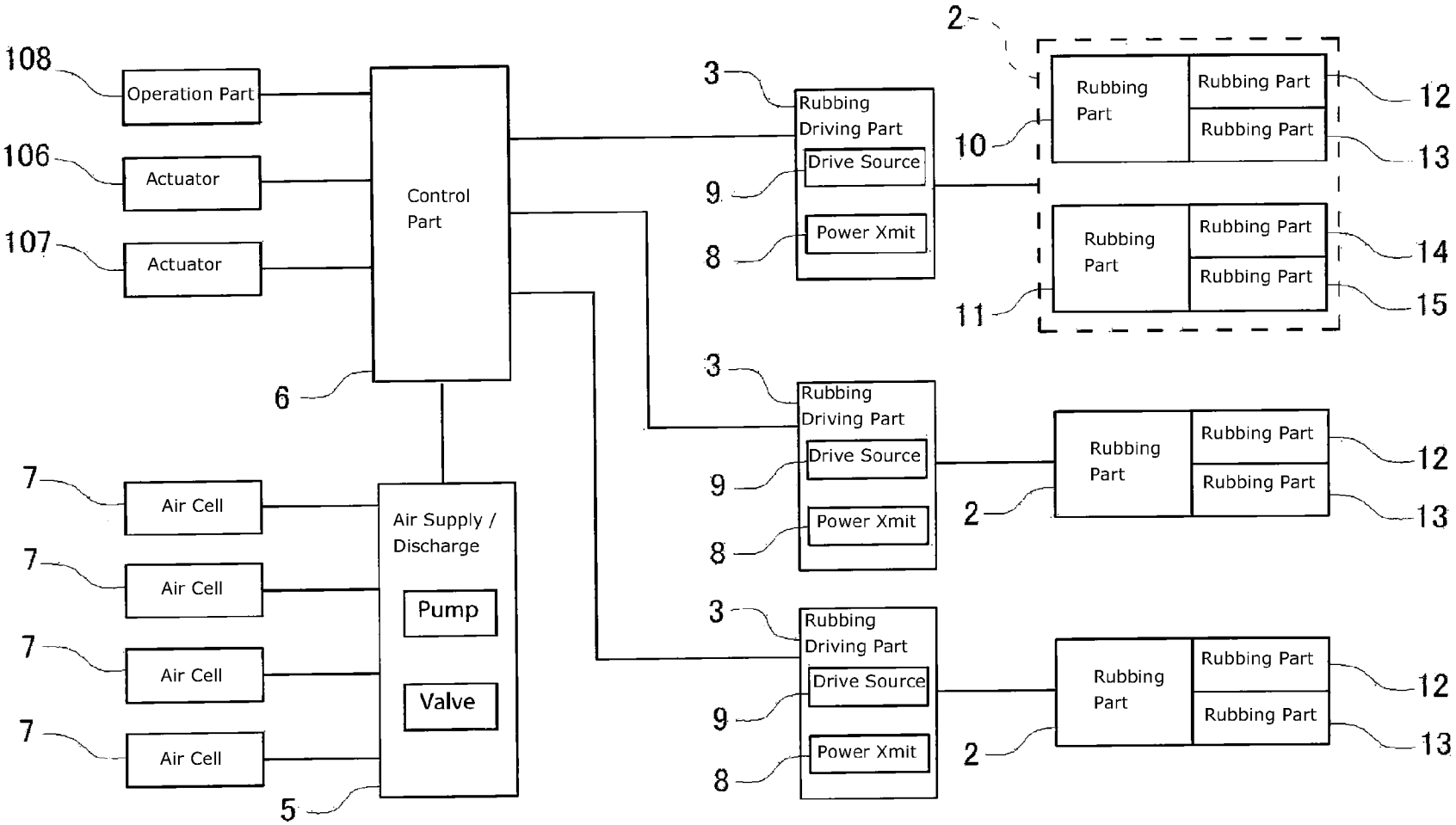
FIG. 2 is a functional block diagram of the chair type massage machine shown in FIG. 1.

As shown in FIGS. 1 and 2, the backrest part 102 can be reclined about an axis in the horizontal direction by an actuator 106 including an electric motor, a fluid pressure cylinder, an air cell, or the like and stopped at an arbitrary position between a standing state shown by a solid line in FIG. 1 and an inclined state shown by a two-dot chain line. In addition, the footrest 103 can be rotated in the vertical direction about an axis in the horizontal direction by an actuator 107 including an electric motor, a fluid pressure cylinder, an air cell, or the like and stopped at an arbitrary position between a raising state shown by a solid line in FIG. 1 and a suspending state shown by a two-dot chain line.

As shown in FIG. 1, this chair type massage machine 100 is provided with the massage machine M1 in front of the seat part 101 as a footrest 103 which performs leg massage, the massage machine M2, which performs hip massage, in the seat part 101, the massage machine M2, which performs body massage, on the backrest part 102, and the massage machines M2, which perform arm massage, on the both armrest parts 104 and 104.

First Embodiment

Figure 3:
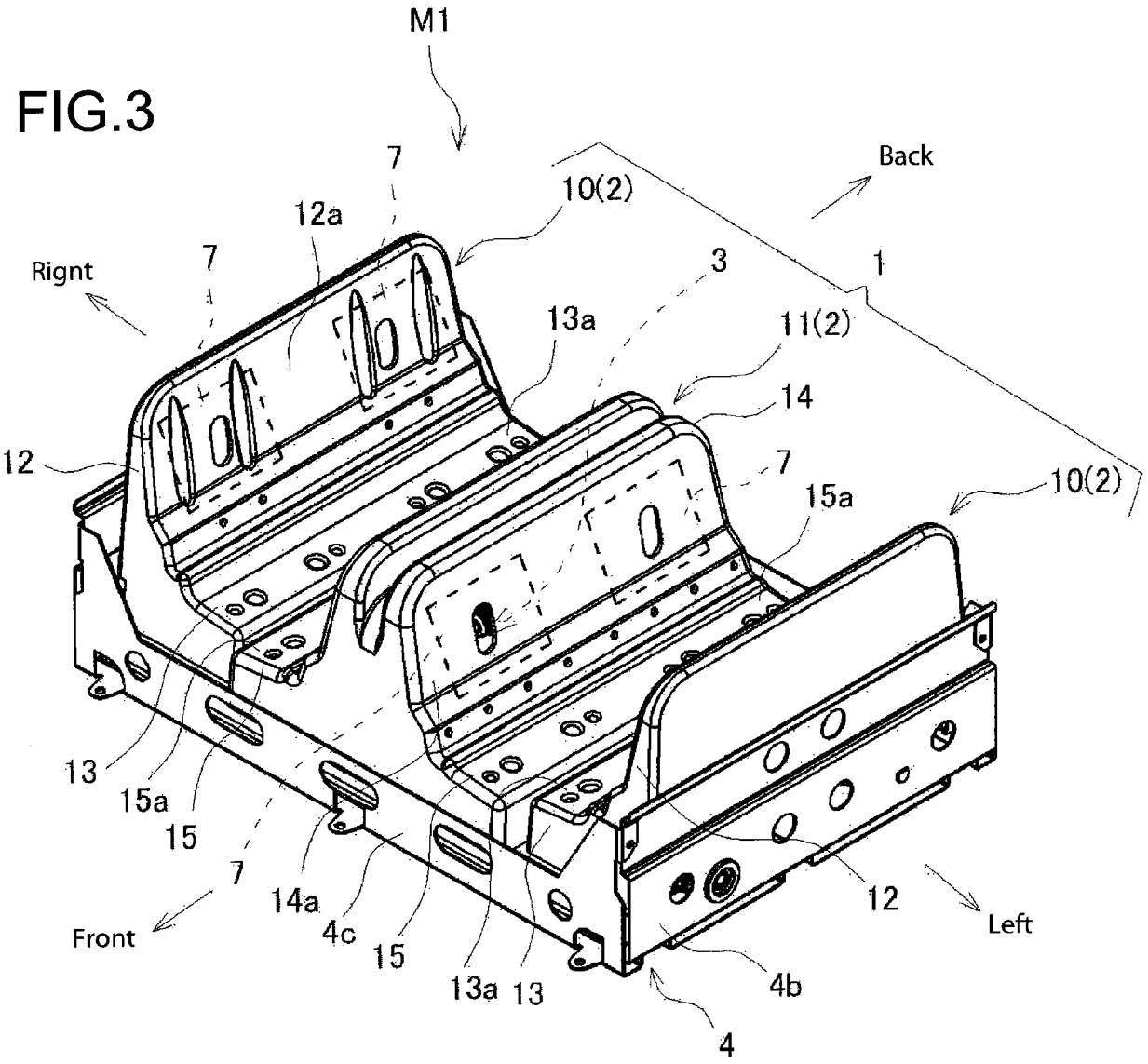
FIG. 3 is a front perspective view of the massage machine according to the first embodiment.
Figure 4:
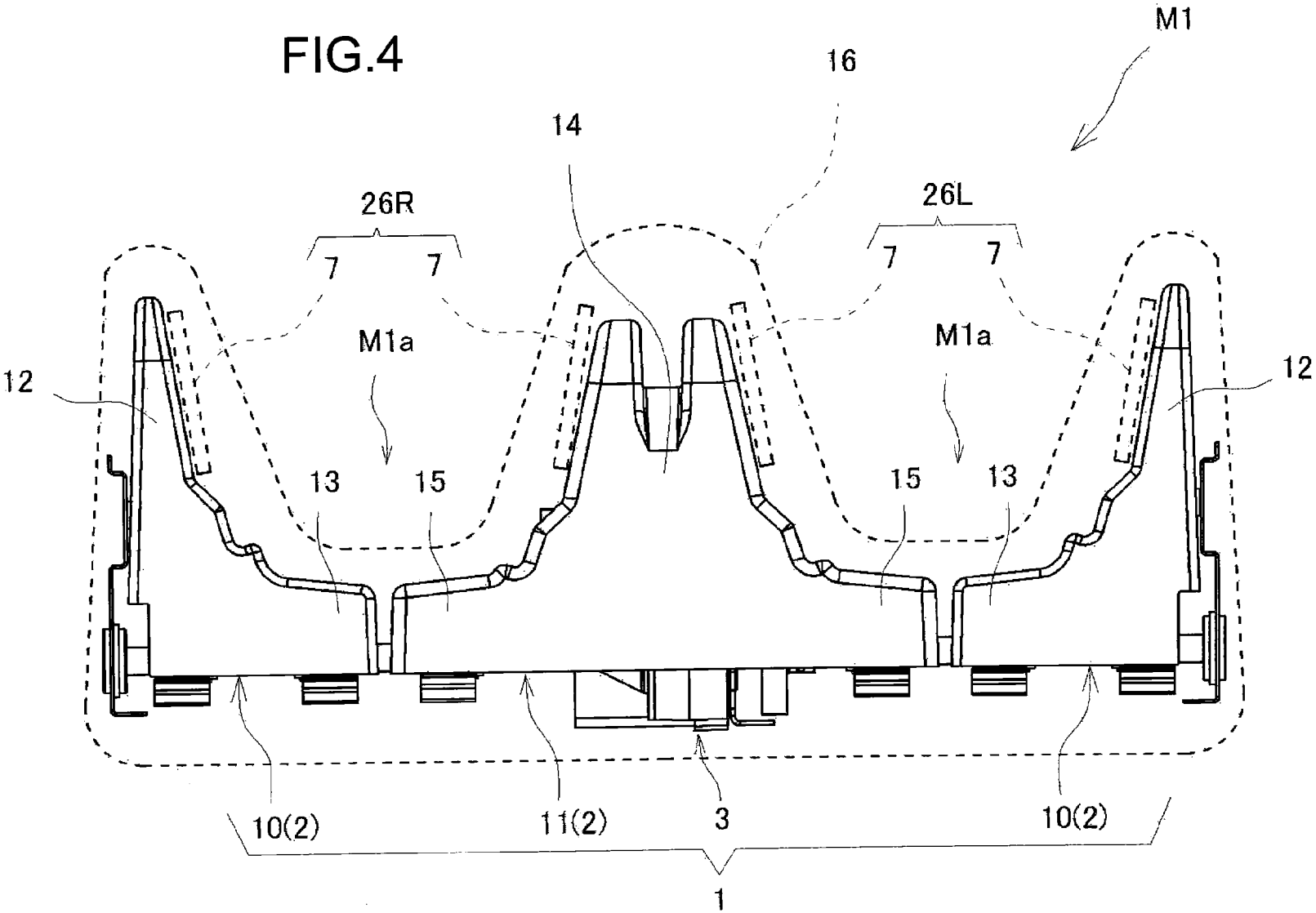
FIG. 4 is a front view of the massage machine in which a base part is omitted.
Figure 5:
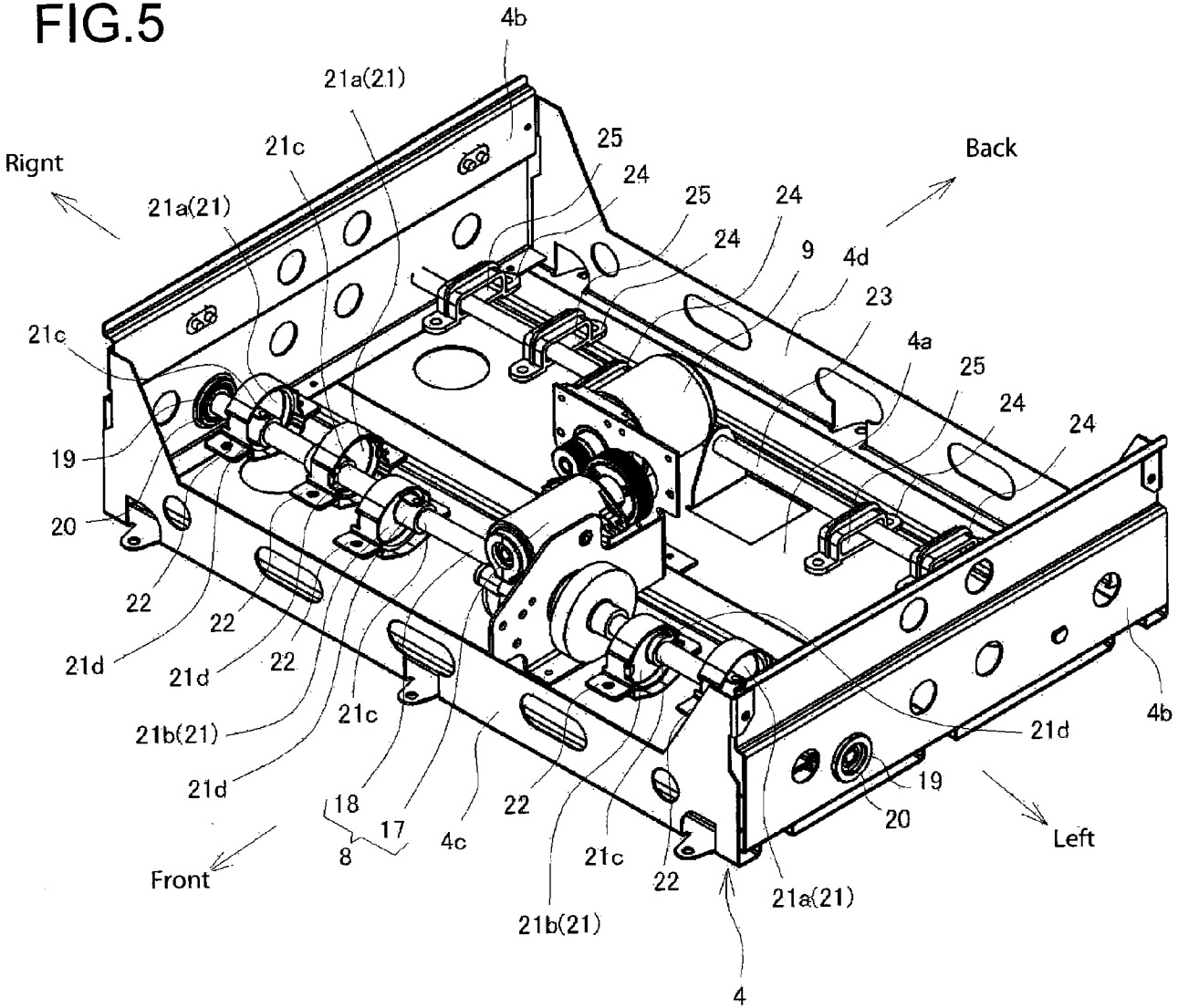
FIG. 5 is a front perspective view of the massage machine in which a rubbing part is omitted.
Figure 6:
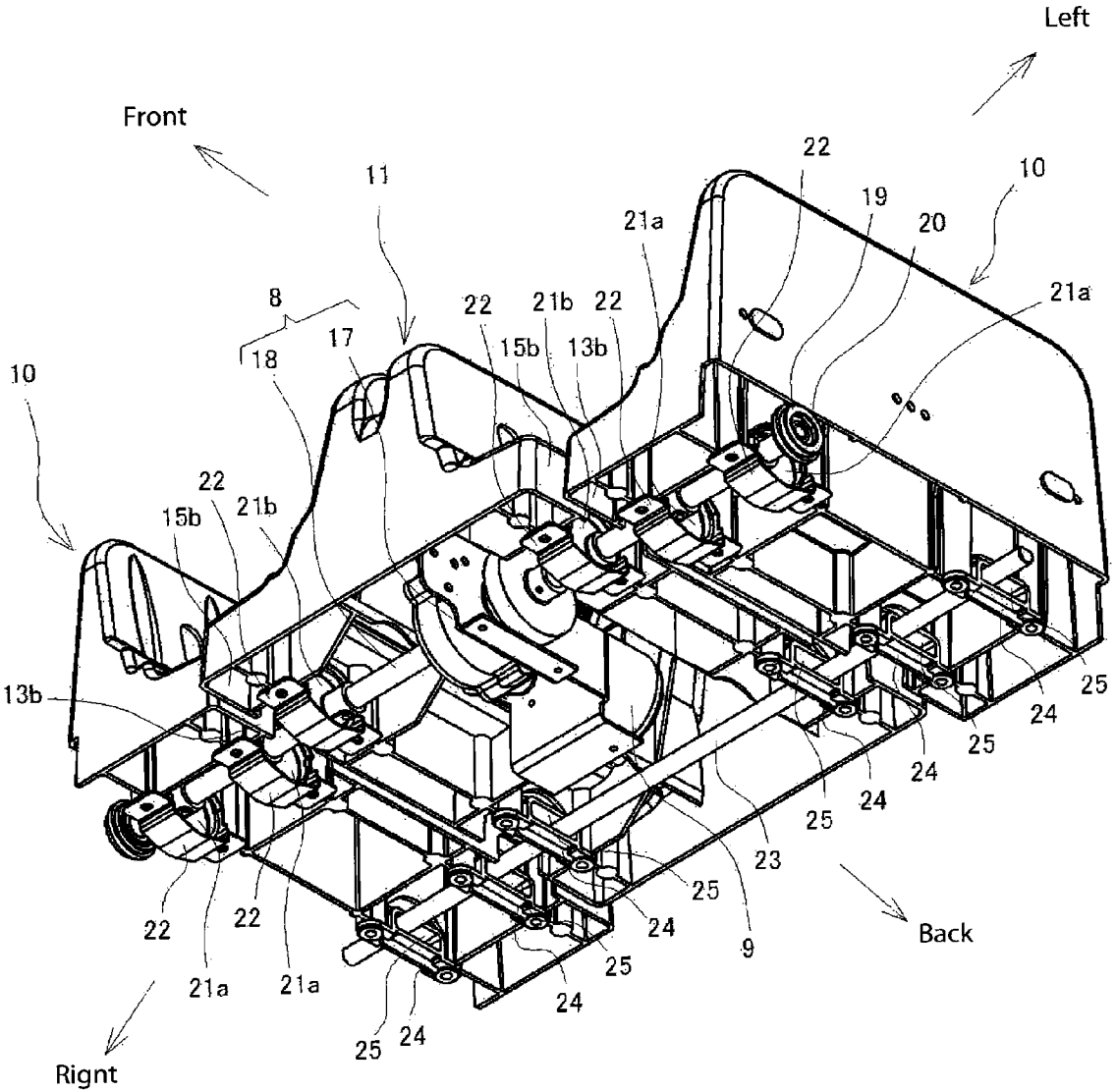
FIG. 6 is a front perspective view of the massage machine in which the base part is omitted.

Hereinafter, description will be made of the configuration of the massage machine M1 according to the first embodiment of the present invention with reference to FIGS. 3 to 6. FIG. 3 is a front perspective view of the massage machine M1, FIG. 4 is a front view of the massage machine M1 in which a base part 4 is omitted, FIG. 5 is a front perspective view of the massage machine M1 in which a rubbing part 2 is omitted, and FIG. 6 is a front perspective view of the massage machine M1 in which the base part 4 is omitted.

[Overall Configuration of Massage Machine]

As shown in FIG. 1, the massage machine M1 is provided such that the side of one end in the front-back direction (front portion) can be rotated in the vertical direction while the side of the other end in the front-back direction (back portion) is coupled to the front portion of the seat part 101. As shown in FIGS. 3 to 5, this massage machine M1 is constituted by a rubbing unit 1 including rubbing parts 2 which respectively perform rubbing massage on each side surface of both legs of the person to be treated and a rubbing driving part 3 which drives these rubbing parts 2, and a base part 4 which is coupled to the front portion of the seat part 101 to support the rubbing unit 1.

As shown in FIGS. 1 and 2, an air supply/discharge apparatus 5 including a pump, a valve, and the like which supplies and discharges air to and from the air cell 7 as a massage part provided in the massage machine M1, which will be described later, and a control part 6 such as a microcomputer including a CPU which drives and controls the rubbing driving part 3 and the air supply/discharge apparatus 5, a memory (RAM), and a storage part (ROM). This control part 6 is electrically connected to an operation part 108 operated by a person to be treated and outputs an output signal for driving and controlling the rubbing driving part 3, the air supply/discharge apparatus 5, and actuators 106 and 107 based on the input signal input from the operation part 108.

[Configuration of Base Part]

As shown in FIG. 5, the base part 4 has a configuration in which the upper side thereof is opened by a plate-shaped bottom portion 4*a*, plate-shaped side portions 4*b* and 4*b* provided so as to stand on both left and right sides of the bottom portion 4*a*, a plate-shaped front portion 4*c* provided so as to stand on the front side of the bottom 4*a*, and a plate-shaped back portion 4*d* provided so as to stand on the back side of the bottom portion 4*a*. The rubbing part 2 is movably supported at the left and right side portions 4*b* and 4*b* of the base part 4 through a power transmission part 8 which will be described later. In addition, the power transmission part 8 and the rubbing driving source 9 constituted by a motor and the like which drives the rubbing part 2 through the power transmission part 8 are supported at the bottom portion 4*a* of the base part 4.

[Configuration of Rubbing Part]

As shown in FIGS. 3 to 6, the rubbing part 2 includes a pair of left and right external rubbing parts 10 and 10 which are supported by the base part 4 through the power transmission part 8, coupled to the power transmission part 8 so as to be movable in the vertical and the front-back directions, and arranged on the external sides of both legs, and an intermediate rubbing part 11 which is coupled to the power transmission part 8 so as to be movable in the vertical and the front-back directions and arranged between the pair of left and right external rubbing parts 10 and 10.

The external rubbing part 10 is constituted by a plate-shaped first rubbing part 12 including a facing inner surface 12*a* facing the external surface of the leg and a plate-shaped second rubbing part 13 including a facing inner bottom surface 13*a* which is integrally configured with the first rubbing part 12, provided so as to extend from the lower end portion to the left and right inner sides of the first rubbing part 12, and faces the back surface of the leg, while the pair of left and right external rubbing parts 10 and 10 are movably supported by both side portions 4*b* and 4*b* of the base part 4 through the power transmission part 8.

The intermediate rubbing part 11 includes a plate-shaped first rubbing part 14 including the facing inner surfaces 14*a* and 14*a* which respectively face the inner surfaces of both legs and plate-shaped second rubbing parts 15 and 15 including facing inner bottom surfaces 15*a* and 15*a* which are integrally configured with the first rubbing part 14, provided so as to extend from the lower end portion to both the left and right sides of the first rubbing part 14, and faces the back surfaces of both legs, while the intermediate rubbing part 11 is movably supported by the both side portions 4*b* and 4*b* of the base part 4 through the power transmission part 8.

The first rubbing parts 12 and 14 included in the pair of left and right external rubbing parts 10 and 10 and the intermediate rubbing part 11 and the second rubbing parts 13 and 15 included in the pair of left and right external rubbing parts 10 and 10 and the intermediate part 11 constitute a pair of left and right recessed portions M1*a* and M1*a* which contain the leg openings at their upper sides and the both front and back ends, both side surfaces of both legs contained in this pair of left and right recessed portions M1*a* and M1*a* are supported by the first rubbing parts 12 and 14 while the back surface of both legs is supported by the second rubbing parts 13 and 15.

As shown in FIGS. 3 and 4, the first rubbing parts 12 and 14 included in the pair of left and right external rubbing parts 10 and 10 and the intermediate rubbing part 11 have substantially rectangular shapes when viewed from the side with a longer dimension in the front-back direction (the longitudinal direction of the legs) while the facing inner surfaces 12*a* and 14*a* of the first rubbing parts 12 and 14 are inclined surfaces in which the lower end sides are slightly inclined inwardly. In addition, the first rubbing parts 12 and 14 have air cells 7 which press the external surfaces of the legs of the person to be treated, which will be described later, and a plurality of air cells 7 is provided in the facing inner surfaces 12*a* and 14*a* of the first rubbing part 12 and 14 along the front-back direction (the longitudinal direction of the legs). These air cells 7 are connected to the air supply/discharge apparatus 5 through an air piping (not shown) so as to be able to be expanded and contracted by the supply and discharge of the air.

The second rubbing parts 13 and 15 included in the pair of left and right external rubbing parts 10 and 10 and the intermediate part 11 have substantially rectangular shapes when viewed from the upper direction of the longer dimension in the front-back direction (the longitudinal direction of the legs), and the facing inner bottom surfaces 13*a* and 15*a* of the second rubbing parts 13 and 15 are inclined surfaces in which the inner end sides are slightly inclined downwardly. In addition, the second rubbing part 13 of the external rubbing part 10 and the second rubbing part 15 of the intermediate rubbing part 11 are arranged to be close to each other such that the leg does not fall into the gap between both the second rubbing parts 13 and 15.

As shown in FIG. 4, the rubbing part 2 constituted by the pair of left and right external rubbing parts 10 and 10 and the intermediate part 11 is integrally covered with a cover part 16 constituted by a cloth or the like with the stretch surface so as to prevent the rubbing part 2 from being exposed to the outside and reduce the risk of the leg being trapped between both the second rubbing parts 13 and 15.

[Configuration of Rubbing Driving Part]

Hereinafter, description will be made of the configuration of the rubbing driving part 3 with reference to FIGS. 5 and 6.

As shown in FIGS. 5 and 6, the rubbing driving part 3 includes a rubbing driving source 9 such as a motor and the like driven by the control part 6 and a power transmission part 8 which transmits the rotation power of the rubbing driving source 9 to cause the rubbing part 2 to act, and the rubbing driving part 3 is provided in the base part 4. The output axis of the rubbing driving source 9 is provided along the front-back direction (the longitudinal direction of the legs), and the power transmission part 8 includes a gear case 17 with a worm gear to change the rotation direction of the output axis of the rubbing driving source 9 for deceleration and a transmission shaft 18 which is connected to this worm gear and rotated about an axial center directing to the horizontal direction (the width direction of the legs). This transmission shaft 18 is rotatably supported on the one end side (the front end portion in this embodiment) in the front-back direction of the base part 4. In this embodiment, the rubbing driving source 9 is constituted by a motor and the rotation direction and the rotation speed of the output axis thereof are configured to be variable by the control part 6.

Both the left and right ends of the transmission shaft 18 are rotatably supported by both side portions 4*b* and 4*b* of the base portion 4, and more specifically, supported by ring-shaped first holders 19 and 19 included in both side portions 4*b* and 4*b* through the bearing 20 externally fitted onto the outer circumferential portion of the rotation axis of the transmission shaft 18. In addition, an eccentric cam 21 is provided at a position corresponding to each rubbing part 2 in a midway portion of the transmission shaft 18 in the horizontal direction, and more specifically, two each of the external eccentric cams 21*a* which are coupled to the pair of left and right external rubbing parts 10 and 10 are provided on the left and right sides, two intermediate eccentric cams 21*b* which are coupled to the intermediate rubbing part 11 are provided on the left and right sides, and a total of 6 eccentric cams 21 are provided.

Such eccentric cams 21 have disk shapes with a thickness in the horizontal direction, and a rotation axis center 21*c* is provided at a position distant from the center of the geometric circle of the outer shape. In addition, this rotation axis center 21*c* coincides with the axial center of the transmission shaft 18. The rotation axis center 21*c* of the eccentric cam 21 has a through hole 21*d* which penetrates therethrough in the horizontal direction, the eccentric cam 21 is supported by the transmission shaft 18 by inserting the transmission shaft 18 into this through hole 21*d*, and this plurality of eccentric cams 21 can be integrally rotated with the transmission shaft 18. Moreover, the external eccentric cams 21*a*, 21*a*, 21*a*, and 21*a* coupled to the pair of left and right external rubbing parts 10 and 10 have the same phases with respect to the rotation axis center 21*c* while the external eccentric cams 21*a*, 21*a*, 21*a*, and 21*a* coupled to the pair of left and right external rubbing parts 10 and 10 have different phases with respect to the rotation axis center 21*c* from those of the intermediate eccentric cams 21*b* and 21*b* coupled to the intermediate rubbing part 11. In the first embodiment, the phases of the external eccentric cam 21*a* and the intermediate eccentric cam 21*b* with respect to the rotation axis center 21*c* are different from each other by 180°.

Furthermore, these eccentric cams 21 are attached to the external rubbing part 10 and the intermediate rubbing part 11 through the ring-shaped second holder 22 with an opening directed to the horizontal direction. This second holder 22 is attached to each rubbing part 2 by a coupling means (not shown) such as a bolt, and the eccentric cam 21 is loosely fitted into the ring-shaped second holder 22.

A rod-shaped guide shaft 23 with an axial center which guides the displacement of the rubbing part 2 with respect to the base part 4 and is directed to the horizontal direction is supported by the other end side (the back end in this embodiment) in the front-back direction of the base part 4, and more specifically, both the left and right end portions of this guide shaft 23 are supported by both side portions 4*b* and 4*b* while the midway portion in the horizontal direction is supported by the bottom portion 4*a* of the base part so as not to be rotated. This guide shaft 23 is attached to the other end side (the back end in this embodiment) in the front-back direction of the external rubbing part 10 and the intermediate rubbing part 11 through the third holder 24, and more specifically, inserted into a guide hole 25 which opens in the horizontal direction of the longer dimension in the longitudinal direction of the legs included in the third holder 24. This third holder is provided corresponding to each rubbing part 2 (that is, corresponding to the pair of left and right external rubbing parts 10 and 10 and the intermediate part 11), and one guide shaft 23 is inserted into the guide holes included in the third holder provided in each rubbing part 2 in a skewered manner. Accordingly, each rubbing part 2 can be relatively displaced in the front-back direction along the longitudinal direction of the guide holes 25 within the range of the guide holes 25 while the rotation of the other end side is restricted by the guide shaft 23.

[Configuration of Massage Part]

Hereinafter, description will be made of the configuration of the massage part included in the rubbing part 2 with reference to FIG. 3.

As shown in FIG. 3, an air cell 7 which expands and contracts due to the supply and the discharge of the air shown by a broken line is employed as the massage part in this embodiment, which performs a massage on the body part of the person to be treated. The air cells 7 are provided in the facing inner surfaces 12*a* and 14*a* of the first rubbing parts 12 and 14 included in the pair of outer rubbing parts 10 and 10 and the intermediate rubbing part 11, and have substantially flat shapes in the side view during the contraction, and are expanded inwardly in the horizontal direction during the expansion when air is supplied from the air supply/discharge apparatus 5. In addition, these air cells 7 may have an undevelopable base part with a lower portion attached to the facing inner surfaces 12*a* and 14*a* of the first rubbing parts 12 and 14 and a developing part with an upper portion which can be developed inwardly in the horizontal direction such that these air cells 7 have substantially flat shapes in the side view during the contraction and the developing part is expanded and developed inwardly in the horizontal direction in an accordion-like manner with respect to the base part during the expansion when air is supplied from the air supply/discharge apparatus 5.

These air cells 7 are provided in the inner surface 12*a* of the first rubbing part 12 included in the external rubbing part 10 and both inner surfaces 14*a* and 14*a* of the first rubbing part 14 included in the intermediate rubbing part 11 and constitute an air cell group 26L which presses both side surfaces of the left leg and an air cell group 26R which presses both side surfaces of the right leg. In addition, a plurality of air cell groups 26L and 26R is provided in the front-back direction (the longitudinal direction of the legs), and it is possible to press both legs with the plurality of air cell groups 26L and 26R in accordance with the change in thickness of the legs in the longitudinal direction. Accordingly, when the air supply/discharge apparatus 5 is driven by the output signal from the control part 6, and air is supplied to the plurality of left and right air cell groups 26L and 26R, the pressing massage is performed on the legs due to the expansion of the air cells 7, and the intervals of the recessed portions M1*a* which contain the legs are adjusted to the intervals corresponding to the size of the legs of the person to be treated.

[Actions of Rubbing Part]

Figure 7:
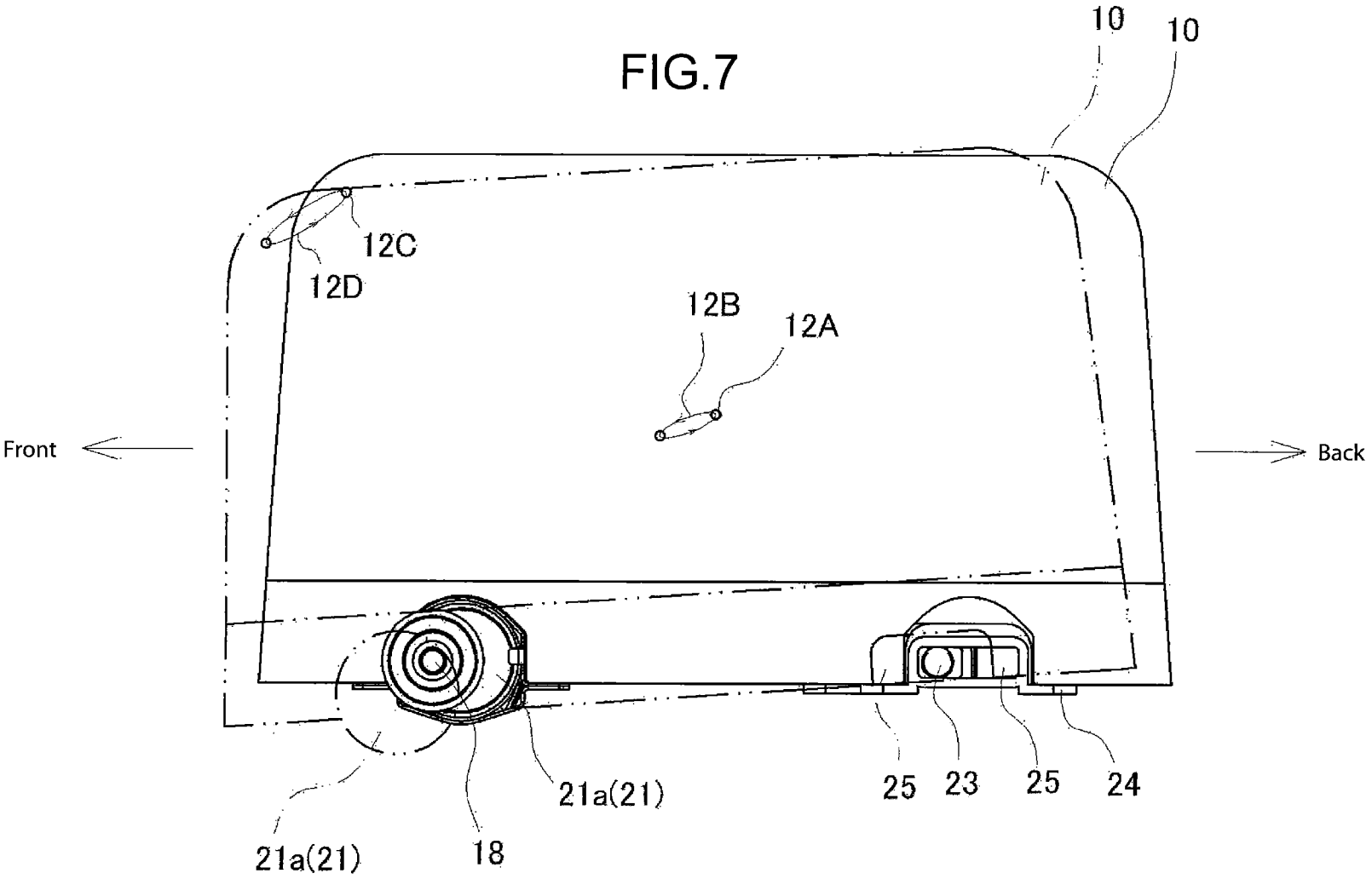
FIG. 7 is a left side view of the massage machine, which illustrates actions of the rubbing part.

Hereinafter, description will be made of/the actions of the rubbing part 2 with reference to FIG. 7. FIG. 7 is a side view of the massage machine M1, which illustrates the actions of the rubbing part 2.

When the rubbing driving source 9 is driven, and the output shaft of the rubbing driving part 3 with the aforementioned configuration is rotated, the transmission shaft 18 provided on one end side (the front end portion in this embodiment) in the front-back direction of the base part 4 is rotated about the axial center in conjunction with the rotation of the output shaft through the gear case 17, and the eccentric cam 21 attached to the left and right midway portion of the transmission shaft 18 revolves about the rotation axis center of the transmission shaft 18. Then, the second holder 22 supporting the eccentric cam 21 is made to perform a circular movement along the revolution track of the eccentric cam 21 due to the revolution of the eccentric cam 21. On the other hand, since the guide shaft 23 provided on the other end side (the back end portion in this embodiment) in the front-back direction of the base part 4 is inserted into the guide holes 25 included in the third holder 24 provided in each rubbing part 2, the circular movement of the rubbing part 2 itself is restricted regardless of the circular movement of the second holder 22. As a result, the rubbing part 2 is reciprocated once in the front-back direction by a predetermined distance and performs an orbiting action for inclination in the front-back direction while the transmission shaft 18 is rotated once.

At this time, a fixed point 12A positioned substantially at the center of the first rubbing part 12 included in the pair of left and right external rubbing parts 10 and 10 in the side view orbits along a substantially oval-shaped track 12B with a longer dimension in the front-back direction while a fixed point 12C positioned at the front portion of the upper end of the first rubbing part 12 orbits along a substantially oval-shaped track 12D with a longer dimension than that of the track of the fixed point 12A. In addition, since the second rubbing part 13 included in the external rubbing part 10 is integrally configured with the first rubbing part 12, the second rubbing part 13 performs an orbiting action for inclination in the front-back direction while being reciprocated once in the front-back direction by a predetermined distance in conjunction with the orbiting of the first rubbing part 12. Moreover, the rubbing driving source 9 of the rubbing driving part 3 is electrically connected to the control part 6 through a drive circuit (not shown), and the action thereof is controlled by an electric signal output from the drive circuit based on the control signal from the control part 6.

Incidentally, the external eccentric cam 21*a* attached to the external rubbing part 10 and the intermediate eccentric cam 21*b* attached to the intermediate rubbing part 11 have phases which are different from each other by 180° as described above. Accordingly, the phases of the orbiting external rubbing parts 10 and 10 and the intermediate rubbing part 11 are different from each other by 180°, and therefore, the external rubbing parts 10 and 10 and the intermediate rubbing part 11 are displaced in the opposite directions. That is, the intermediate part 11 is displaced to the other side (back side) in the front-back direction while the external rubbing parts 10 and 10 are displaced to one side (front side) in the front-back direction, and the one end side (front end portion) of the intermediate rubbing part 11 is displaced to the other side (downward) in the vertical direction and the other end side (back end portion) in the front-back direction is displaced to one side (upward) in the vertical direction when the one end side (front end portion) of the external rubbing parts 10 and 10 in the front-back direction is displaced to the one side (upward) in the vertical direction and the other end side (back portion) in the front-back direction is displaced to the other side (downward) in the vertical direction.

[Configuration of Anti-Trap Mechanism]

Figure 8:
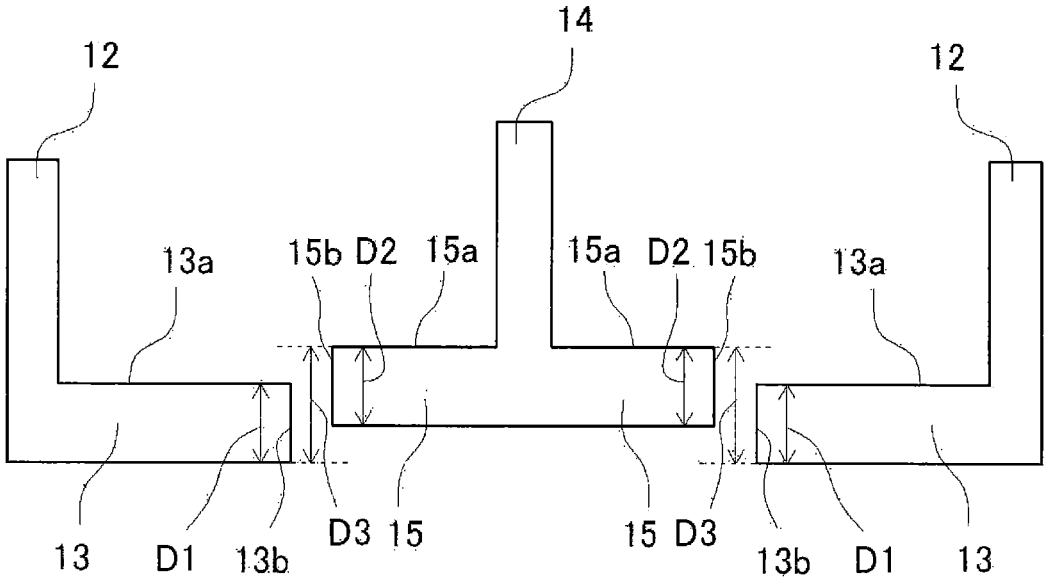
FIG. 8(*a*) is a front view of the massage machine, which schematically shows a state in which one end of an external rubbing part in the front-back direction is at the lowest position while the other end of an intermediate rubbing part in the front-back direction is at the highest position.
Figure 8:
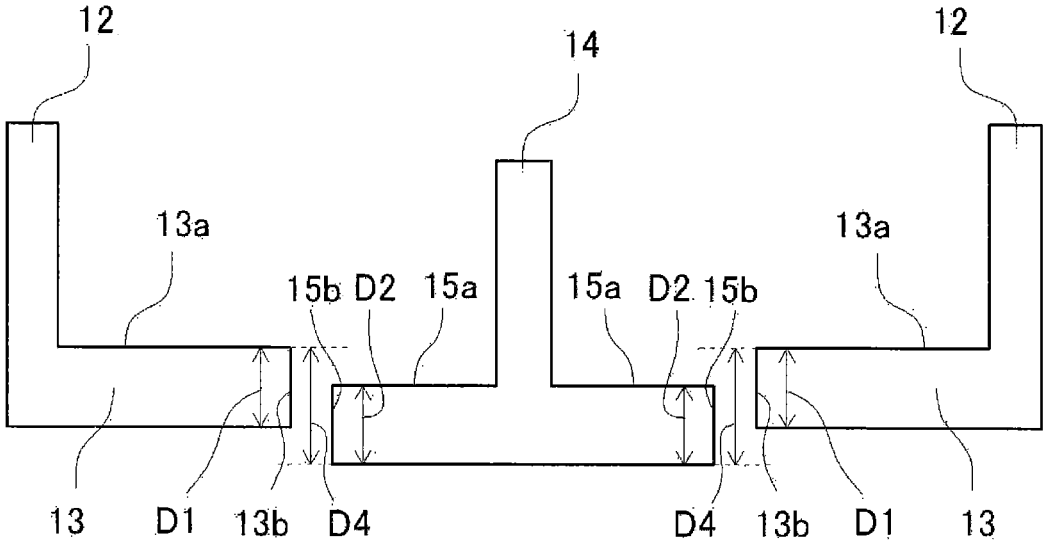

Hereinafter, description will be made of the anti-trap mechanism with reference to FIGS. 4, 6, and 8. FIG. 8(*a*) is a diagram schematically showing the massage machine 1 when viewed from the front thereof in a state in which one end side of the external rubbing part 10 in the front-back direction is in the lowest position while the other end side of the intermediate rubbing part 11 in the front-back direction is in the highest position. FIG. 8(*b*) is a diagram schematically showing the massage machine 1 when viewed from the front thereof in a state in which one end side of the external rubbing part 10 in the front-back direction is in the highest position while the other end side of the intermediate rubbing part 11 in the front-back direction is in the lowest position.

As shown in FIGS. 4 and 6, the external rubbing part 10 is provided so as to extend downwardly from the inner end portion in the horizontal direction of the facing inner bottom surface 13*a* of the second rubbing part 13 and from both the front and back end portions and includes a plate-shaped side wall 13*b* with a predetermined dimension D1 in the vertical direction. In the same manner as in the external rubbing part 10, the intermediate rubbing part 11 is provided so as to extend downwardly from the inner end portion in the horizontal direction of the facing inner bottom surface 15*a* of the second rubbing part 15 and from both the front and back end portions and includes a plate-shaped side wall 15*b* with a predetermined dimension D2 in the vertical direction. Although the predetermined dimension D1 of the side wall 13*b* included in the second rubbing part 13 of the external rubbing part 10 is set to be the same as the predetermined dimension D2 of the side wall 15*b* included in the second rubbing part 15 of the intermediate rubbing part 11 in the first embodiment of the present invention, the dimensions may be set differently.

As shown in FIG. 8(*a*), the setting is made such that a distance D3 from the lower end portion of the side wall 13*b* of the external rubbing part 10 to the upper end portion (the upper surface of the facing inner bottom surface 15*a* of the intermediate rubbing part 11) of the side wall 15*b* of the intermediate rubbing part 11 is smaller than the sum of the predetermined dimension D1 of the side wall 13*b* and the predetermined dimension D2 of the side wall 15*b*, in a state in which the one end side of the external rubbing part 10 in the front-back direction is in the lowest position while the one end side of the intermediate rubbing part 11 in the front-back direction is in the highest position. In addition, as shown in FIG. 8(*b*), the setting is made such that a distance D4 from the upper end portion (the upper surface of the facing inner bottom surface 13*a* of the external rubbing part 10) of the side wall 13*b* of the external rubbing part 10 to the lower end portion of the side wall 15*b* of the intermediate rubbing part 11 is smaller than the sum of the predetermined dimension D1 of the side wall 13*b* and the predetermined dimension D2 of the side wall 15*b*, in a state in which the one end side of the external rubbing part 10 in the front-back direction is in the highest position while the one end side of the intermediate rubbing part 11 in the front-back direction is in the lowest position.

Accordingly, it is possible to prevent the legs from being trapped between the second rubbing part 13 of the external rubbing part 10 and the second rubbing part 15 of the intermediate rubbing part 11 since the side surface of the side wall 13*b* included in the external rubbing part 10 always overlaps the side surface of the side wall 15*b* included in the intermediate rubbing part 11 during the action of the rubbing part 2. That is, the anti-trap mechanism is configured by the side wall 13*b* included in the external rubbing part 10 and the side wall 15*b* included in the intermediate rubbing part 11 in order to prevent the body part (legs) of the person to be treated from being trapped.

[Treatment Pattern]

Hereinafter, description will be made of one example of a treatment pattern of the massage machine M1 with reference to FIGS. 9 and 12.

Figure 9:
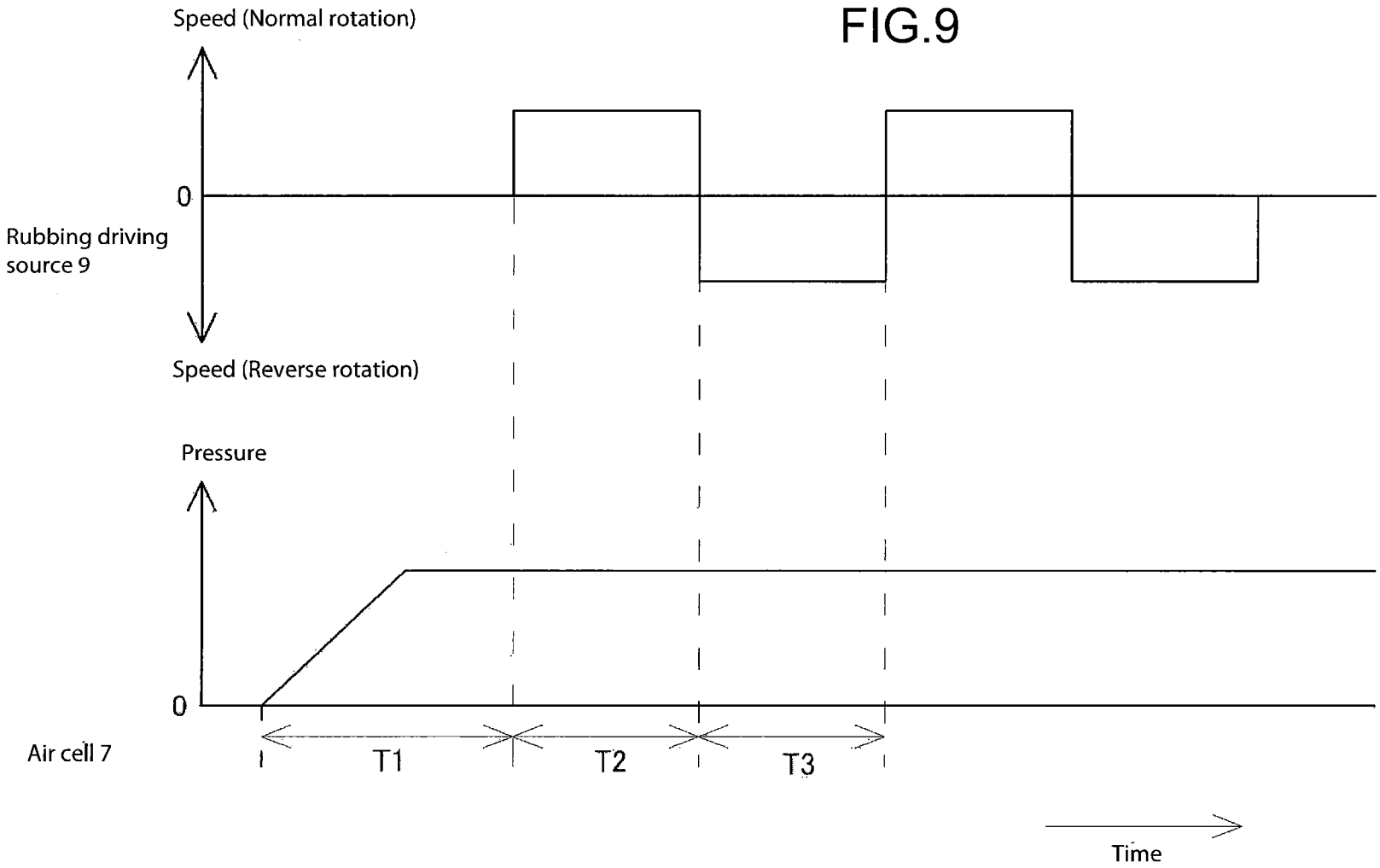
FIG. 9 is an action explanatory diagram of a rubbing driving source and an air cell in a treatment pattern 1.
Figure 11:
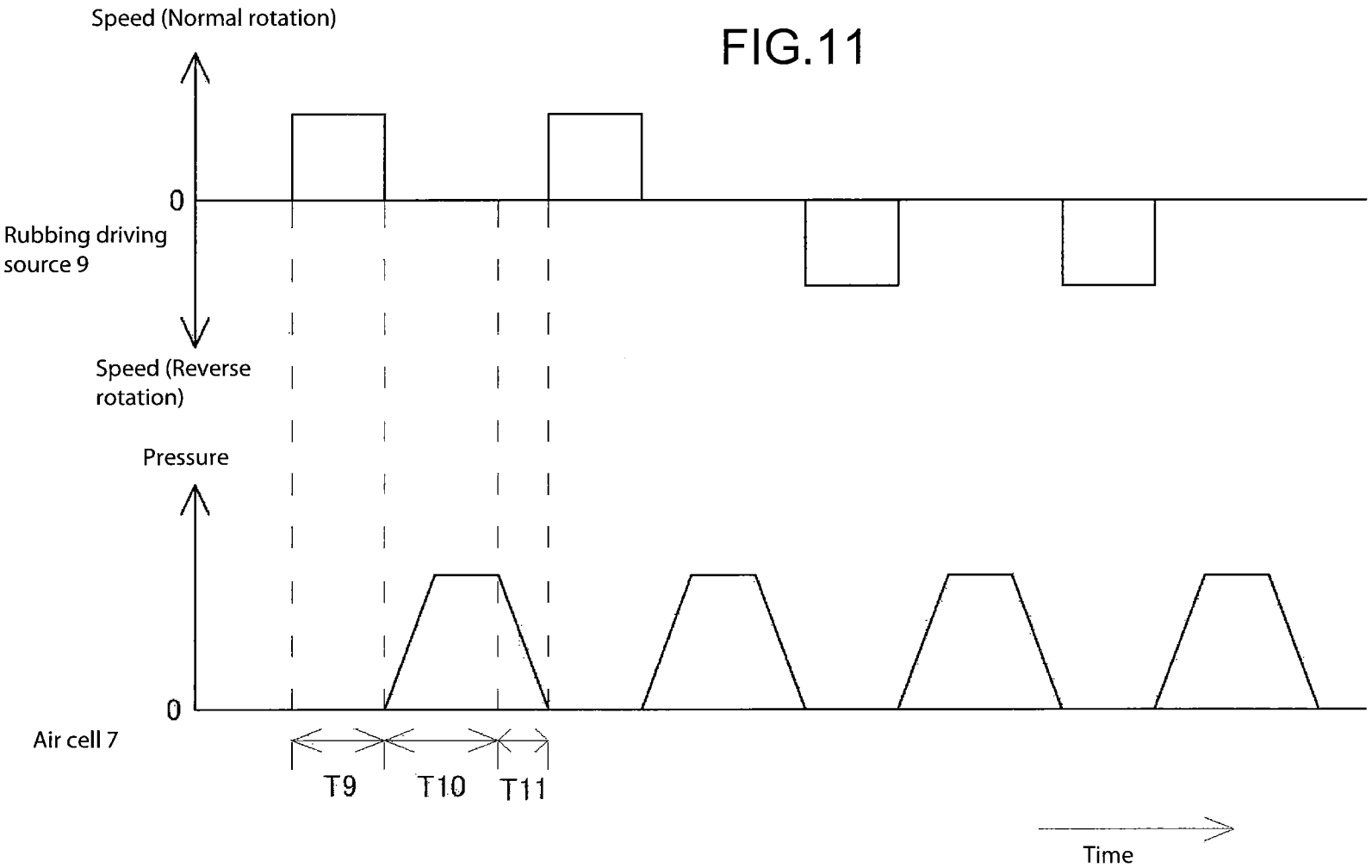
FIG. 11 is an action explanatory diagram of the rubbing driving source and the air cell in a treatment pattern 4.

FIG. 9 is a diagram illustrating actions of the rubbing driving source and the air cell during the treatment pattern 1, FIG. 10(*a*) is a diagram illustrating actions of the rubbing driving source and the air cell during the treatment pattern 2, FIG. 10(*b*) is a diagram illustrating actions of the rubbing driving source and the air cell during the treatment pattern 3, FIG. 11 is a diagram illustrating actions of the rubbing driving source and the air cell during the treatment pattern 4, FIG. 12(*a*) is a diagram illustrating actions of the rubbing driving source and the air cell during the treatment pattern 5, and FIG. 12(*b*) is a diagram illustrating actions of the rubbing driving source and the air cell during the treatment pattern 6.

As shown in FIG. 9, the treatment pattern 1 is a pattern in which both side surfaces of the legs are rubbed while being pinched with the air cell groups 26L and 26R from the left and right sides. The control part 6 drives the rubbing driving source 9 to cause the rubbing part 2 to perform an orbit action in a state in which the expansion of the air cell groups 26L and 26R is maintained after air is supplied to the air cell groups 26L and 26R for expansion. More specifically, air is firstly supplied to the air cell groups 26L and 26R for a predetermined time period T1. After the elapse of the predetermined time period T1, a motor as the rubbing driving source 9 is normally rotated to cause the rubbing part 2 to perform the orbit action for a predetermined time period T2 in a state in which the expansion of the air cell groups 26L and 26R is maintained. After the elapse of the predetermined time period T2, the motor as the rubbing driving source 9 is normally rotated to cause the rubbing part 2 to perform the orbit action in the opposite direction to that in the previous orbit action for a predetermined time period T3 in a state in which the expansion of the air cell groups 26L and 26R is maintained. After the elapse of the predetermined time T3, the normal rotation and the reverse driving of the motor as the rubbing driving source 9 are repeated in a state in which the expansion of the air cell groups 26L and 26R are continuously maintained. The driving speed of the motor as the rubbing driving source 9 may be made to be gradually lower and higher over time during the predetermined time period T2 and/or the predetermined time period T3.

As shown in FIGS. 10(*a*) and 10(*b*), the treatment pattern 2 is a pattern in which the both side surfaces of the legs are rubbed while being pinched with the air cell groups 26L and 26R from both the left and right sides and the force of pinching is gradually strengthened, and the treatment pattern 3 is a pattern in which the both side surface of the legs are rubbed while being pinched with the air cell groups 26L and 26R and the force of pinching is gradually weakened. In the treatment pattern 2, the control part 6 supplies air and expands the air cell groups 26L and 26R in a state in which the orbit action of the rubbing part 2 is maintained after the control part 6 drives the rubbing driving source 9 and causes the rubbing part 2 to perform the orbit action. More specifically, the motor as the rubbing driving source 9 is firstly driven for a predetermined time period T4 (normal rotation or reverse driving), and air is supplied after the elapse of the predetermined time period T4 to the air cell groups 26L and 26R for a predetermined time period T5 in a state in which the motor as the rubbing driving source 9 is driven (a state in which a shift between the normal rotation and the reverse driving of the motor is repeatedly executed) and then discharged. In the treatment pattern 3, the control part 6 supplies air and expands the air cell groups 26L and 26R and then discharges the air and contracts the air cell groups 26L and 26R, drives the rubbing driving source 9 substantially at the same time as the start of the contraction of the air cell groups 26L and 26R, and causes the rubbing part 2 to perform the orbit action. More specifically, air is firstly supplied to the air cell groups 26L and 26R for a predetermined time period T6. After the elapse of the predetermined time period T6, air is discharged from the air cell groups 26L and 26R for a predetermined time period T7. The motor as the rubbing driving source 9 is driven (normal rotation or reverse driving) at substantially the same time as the start of the contraction of the air cell groups 26L and 26R for a predetermined time period T8. According to these treatment patterns 1 to 3, it is possible to loosen muscle fibers that have become fascicles in the diameter directions (horizontal and vertical directions) of the legs.

As shown in FIG. 11, the treatment pattern 4 is a pattern in which the action and stopping of the rubbing part 2 is frequently repeated and the legs are pinched with the air cell groups 26L and 26R from both the left and right sides in a state in which the rubbing part 2 is stopped. The control part 6 drives the rubbing driving source 9 to change the position of the rubbing part 2, then stops the driving of the rubbing driving source 9, supplies air and expands the air cell groups 26L and 26R, and frequently repeats the action and stopping of the rubbing part 2 and the expansion of the air cell groups 26L and 26R in this order. More specifically, the motor as the rubbing driving source 9 is driven (normal rotation or reverse driving) for a predetermined time period T9. After the elapse of the predetermined time period T9, the driving of the rubbing driving source 9 is stopped, and the air is supplied to the air cell groups 26L and 26R at the same time as the stopping of the rubbing driving source 9 for a predetermined time period T10. After the elapse of the predetermined time period T10, the air is discharged from the air cell groups 26L and 26R for a predetermined time period T11. The series of actions performed in the predetermined time periods T9 to T11 are repeated. According to this treatment pattern 4, it is possible to change the positions at which the legs are pinched (pressed) with the air cell groups 26L and 26R.

As shown in FIG. 12(*a*), the treatment pattern 5 is a pattern in which a state where the orbit action speed of the rubbing part 2 is low while the pressing force of the air cell groups 26L and 26R is large is gradually shifted to a state where the orbit action speed of the rubbing part 2 is high while the pressing force of the air cell groups 26L and 26R is small. The control part 6 drives (normal rotation or reverse driving) the rubbing driving part 9 at a predetermined speed S1 for a predetermined time period T12, supplies air to the air cell groups 26L and 26R at substantially the same time as the start of the driving of this rubbing driving source 9 up to a predetermined pressure P1 for a predetermined time period T12 and causes the air cell groups 26L and 26R to maintain it. After the elapse of the predetermined time period T12, the rubbing driving source 9 is driven (normal rotation or reverse driving) at a predetermined speed S2 which is higher than the predetermined speed S1 for a predetermined time period T13, the air is discharged from the air cell groups 26L and 26R at substantially the same time as the rise to the predetermined speed S2 of the rubbing driving source 9 to a predetermined pressure P2 which is lower than the predetermined pressure p1, and the air cell groups 26L and 26R are maintained in this state. After the elapse of the predetermined time period T13, the rubbing driving source 9 is driven (normal rotation or reverse driving) at a predetermined speed S3 which is higher than the predetermined speed S2 for a predetermined time period T14, the air is discharged from the air cell groups 26L and 26R at substantially the same time as the rise to the predetermined speed S3 of the rubbing driving source 9 to a predetermined pressure P3 which is lower than the predetermined pressure p2, and the air cell groups 26L and 26R are maintained in this state. After the elapse of the predetermined time period T14, the rubbing driving source 9 is driven (normal rotation or reverse driving) at a predetermined speed S4 which is higher than the predetermined speed S1 and lower than the predetermined speed S3, the air is discharged from the air cell groups 26L and 26R at substantially the same time as the fall to the predetermined speed S4 of the rubbing driving source 9 to a predetermined pressure P4 which is lower than the predetermined pressure P1 and higher than the predetermined pressure P3 for a predetermined time period T15, and the air cell groups 26L and 26R are maintained in this state.

Although FIG. 12(*a*) shows a configuration in which the rubbing driving source 9 is made to perform normal rotation driving in each of the predetermined time periods T12 to T15, the rubbing driving source 9 may be made to perform only reverse driving or repeatedly perform the shifting between the normal rotation and the reverse driving. Alternatively, it is also applicable to gradually raise or lower the driving speed of the rubbing driving source 9 within a range from the speed 0 to each of the predetermined speeds S1 to S4 over the time elapse in each of the predetermined time periods T12 to T15.

Although FIG. 12(*a*) shows a configuration in which the air is supplied to the air cell groups 26L and 26R up to each of the predetermined pressures P1 to P4 and the air cell groups 26L and 26R are maintained in the expanding state, the expansion and the contraction may be repeatedly performed in each of the predetermined time periods T12 to T15. For example, it is also applicable that the air cell groups 26L and 26R are made to repeat the expansion and the contraction within the range from the pressure 0 to each of the predetermined pressures P1 to P4 or repeat the expansion and the contraction such that the average value of the pressure becomes each of the predetermined pressures P1 to P4.

According to this treatment pattern 5, it is possible to gradually raise the speed of the rhythm in the massage performed on the body part and realize a warm-up operation which is effective right after waking up or the like.

As shown in FIG. 12(*b*), the treatment pattern 6 is a pattern in which a state where the orbit action speed of the rubbing part 2 is high while the pressing force of the air cell groups 26L and 26R is small is gradually shifted to a state where the orbit action speed of the rubbing part 2 is low while the pressing force of the air cell groups 26L and 26R is strong. The control part 6 drives (normal rotation or reverse driving) the rubbing driving source 9 at a predetermined speed S5 for a predetermined time period T16, supplies air to the air cell groups 26L and 26R at substantially the same time as the start of the driving of this rubbing driving source 9 up to a predetermined pressure P5 for a predetermined time period T16 and causes the air cell groups 26L and 26R to maintain it. After the elapse of the predetermined time period T16, the rubbing driving source 9 is driven (normal rotation or reverse driving) at a predetermined speed S6 which is lower than the predetermined speed S5 for a predetermined time period T17, the air is supplied to the air cell groups 26L and 26R at substantially the same time as the fall to the predetermined speed S6 of the rubbing driving source 9 to a predetermined pressure P6 which is higher than the predetermined pressure P5 for a predetermined time period T17, and the air cell groups 26L and 26R are maintained in this state. After the elapse of the predetermined time period T17, the rubbing driving source 9 is driven (normal rotation or reverse driving) at a predetermined speed S7 which is lower than the predetermined speed S6 for a predetermined time period T18, the air is supplied to the air cell groups 26L and 26R at substantially the same time as the fall to the predetermined speed S7 of the rubbing driving source 9 to a predetermined pressure P7 which is higher than the predetermined pressure P6 for a predetermined time period T18, and the air cell groups 26L and 26R are maintained in this state. After the elapse of the predetermined time period T18, the rubbing driving source 9 is driven (normal rotation or reverse driving) at a predetermined speed S8 which is lower than the predetermined speed S5 and higher than the predetermined speed S7 for a predetermined time period T19, the air is discharged from the air cell groups 26L and 26R at substantially the same time as the rise to the predetermined speed S8 of this rubbing driving source 9 to a predetermined pressure P8 which is higher than the predetermined pressure P5 and lower than the predetermined pressure P7 for a predetermined time period T19, and the air cell groups 26L and 26R are maintained in this state.

Although FIG. 12(*b*) shows a configuration in which the rubbing driving source 9 is made to perform normal rotation driving in each of the predetermined time periods T16 to T19, the rubbing driving source 9 may be made to perform only reverse driving or repeatedly perform the shifting between the normal rotation and the reverse driving. Alternatively, the driving speed of the rubbing driving source 9 may be gradually raise or lower within a range from the speed 0 to each of the predetermined speeds S5 to S8 over time in each of the predetermined time periods T16 to T19.

Although FIG. 12(*b*) shows a configuration in which the air is supplied to the air cell groups 26L and 26R up to each of the predetermined pressures P5 to P8 and the air cell groups 26L and 26R are maintained in the expanding state in each of the predetermined time periods T16 to T19, expansion and contraction may be repeatedly performed in each of the predetermined time periods T16 to T19. For example, the air cell groups 26L and 26R may be made to repeat the expansion and the contraction within the range from the pressure 0 to each of the predetermined pressures P5 to P8 or repeat the expansion and the contraction such that the average value of the pressure becomes each of the predetermined pressures P5 to P8, in each of the predetermined time periods T16 to T19.

According to this treatment pattern 6, it is possible to gradually lower the speed of the rhythm of the massage performed on the body part and realize a cool-down action which is effective before sleeping or the like.

Second Embodiment

Figure 13:
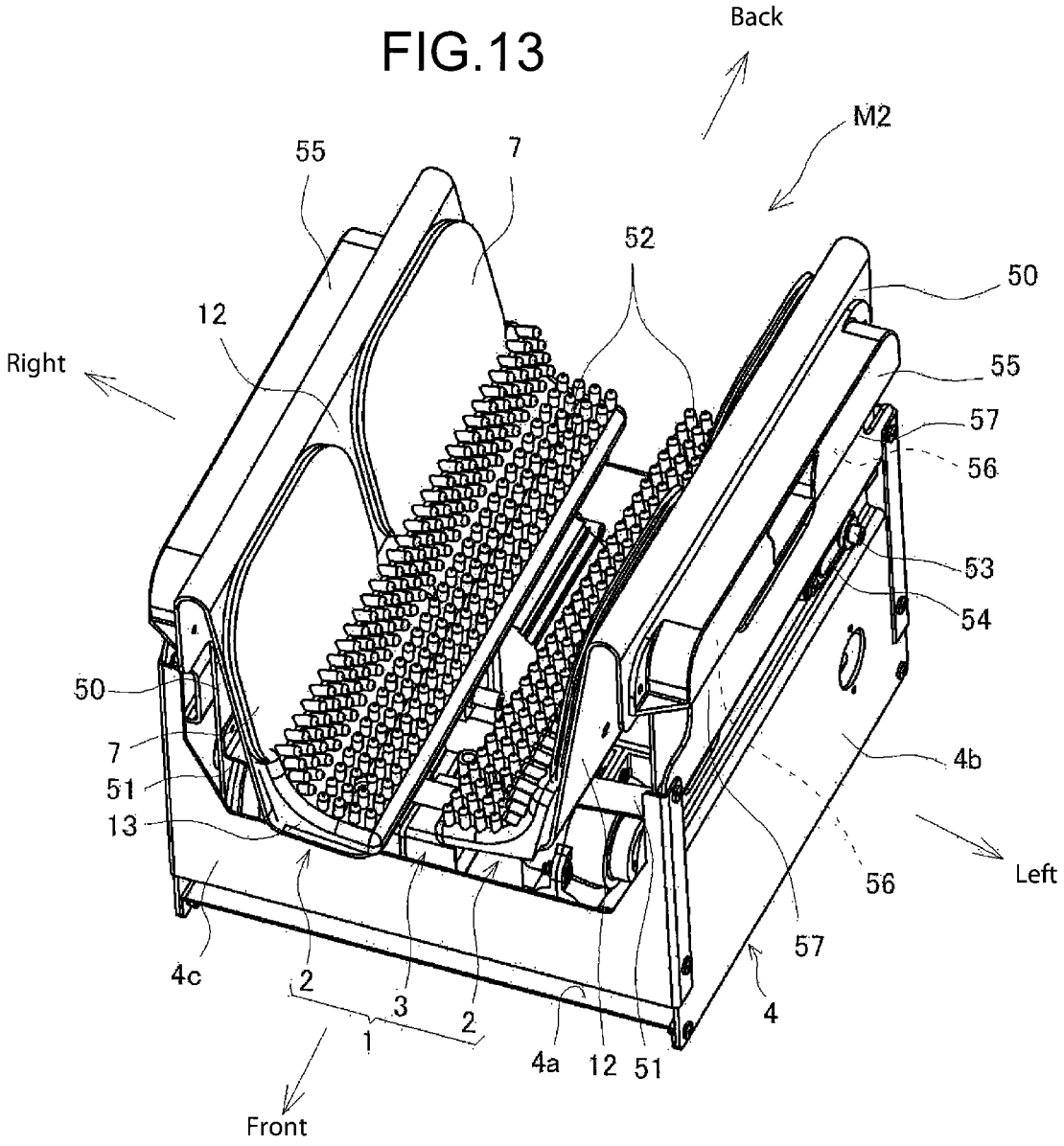
FIG. 13 is a front perspective view of the massage machine according to the second embodiment.
Figure 16:
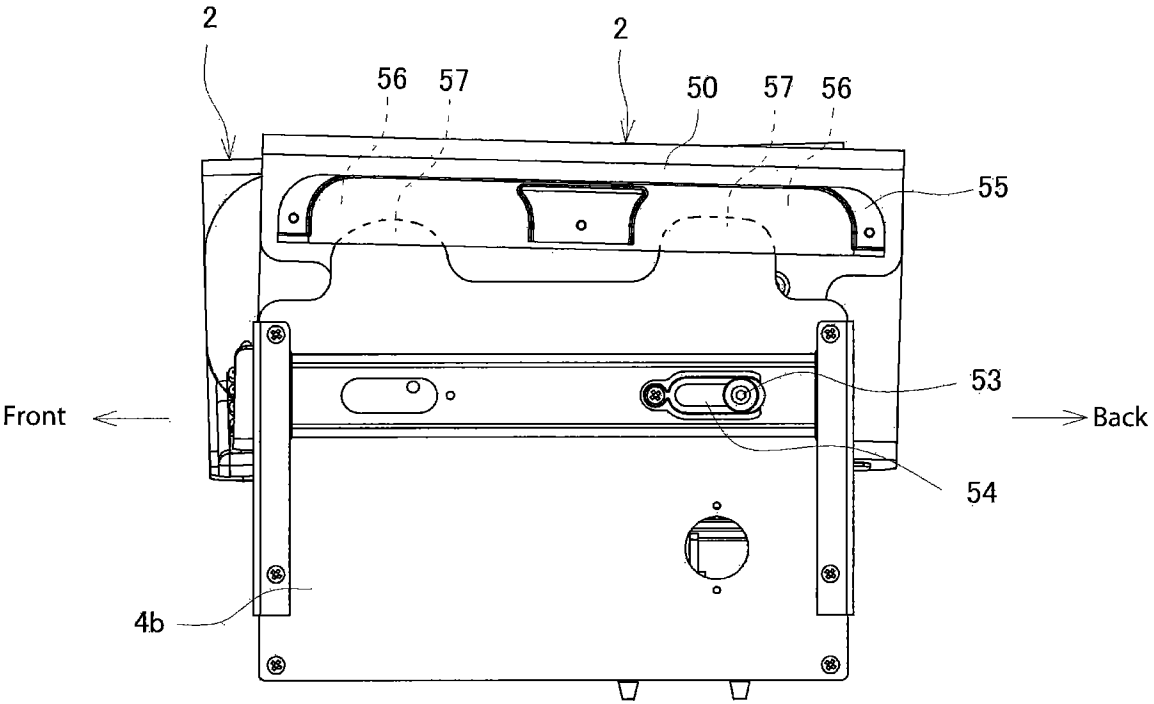
FIG. 16 is a left side view of the massage machine.
Figure 17:
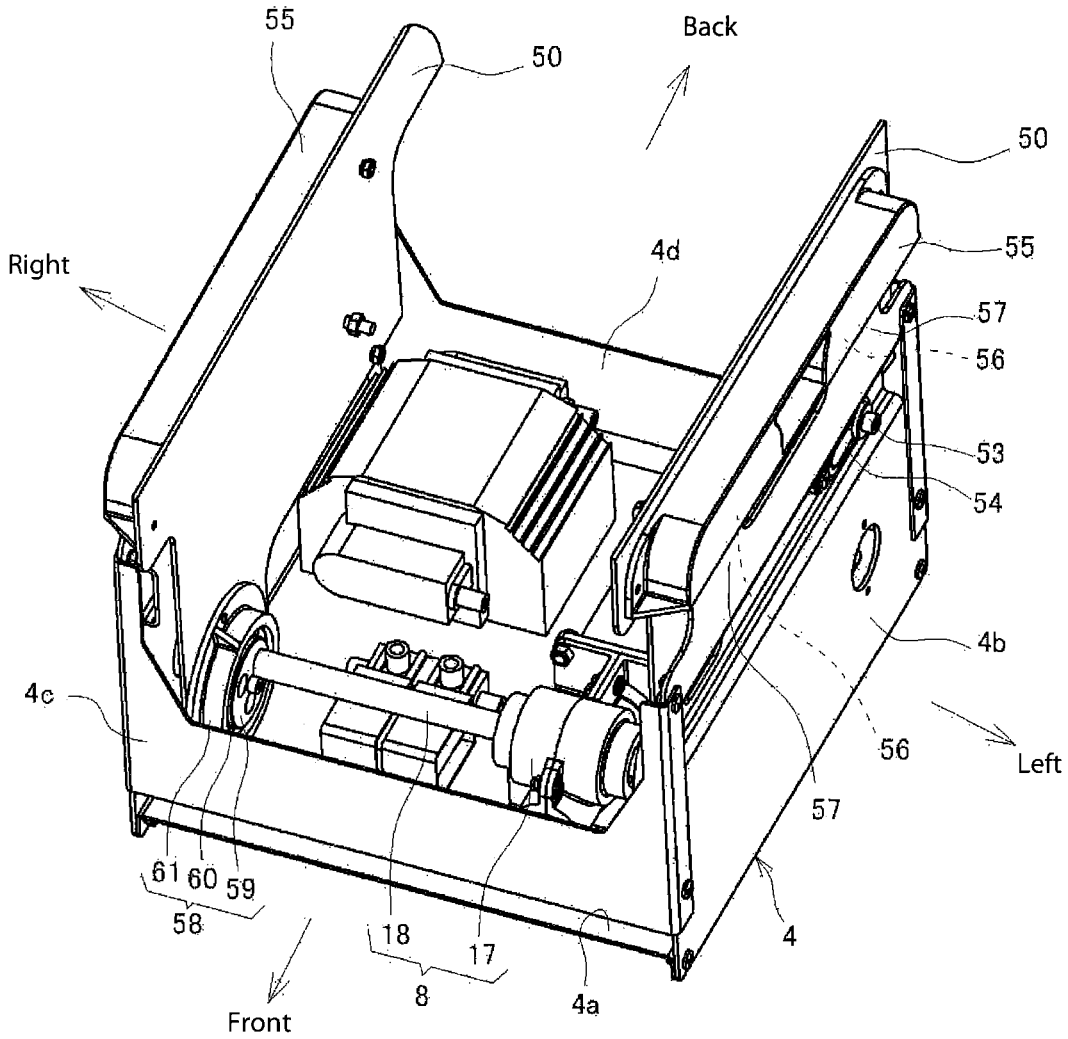
FIG. 17 is a front perspective view of the massage machine in which a part of the rubbing part is omitted.
Figure 18:
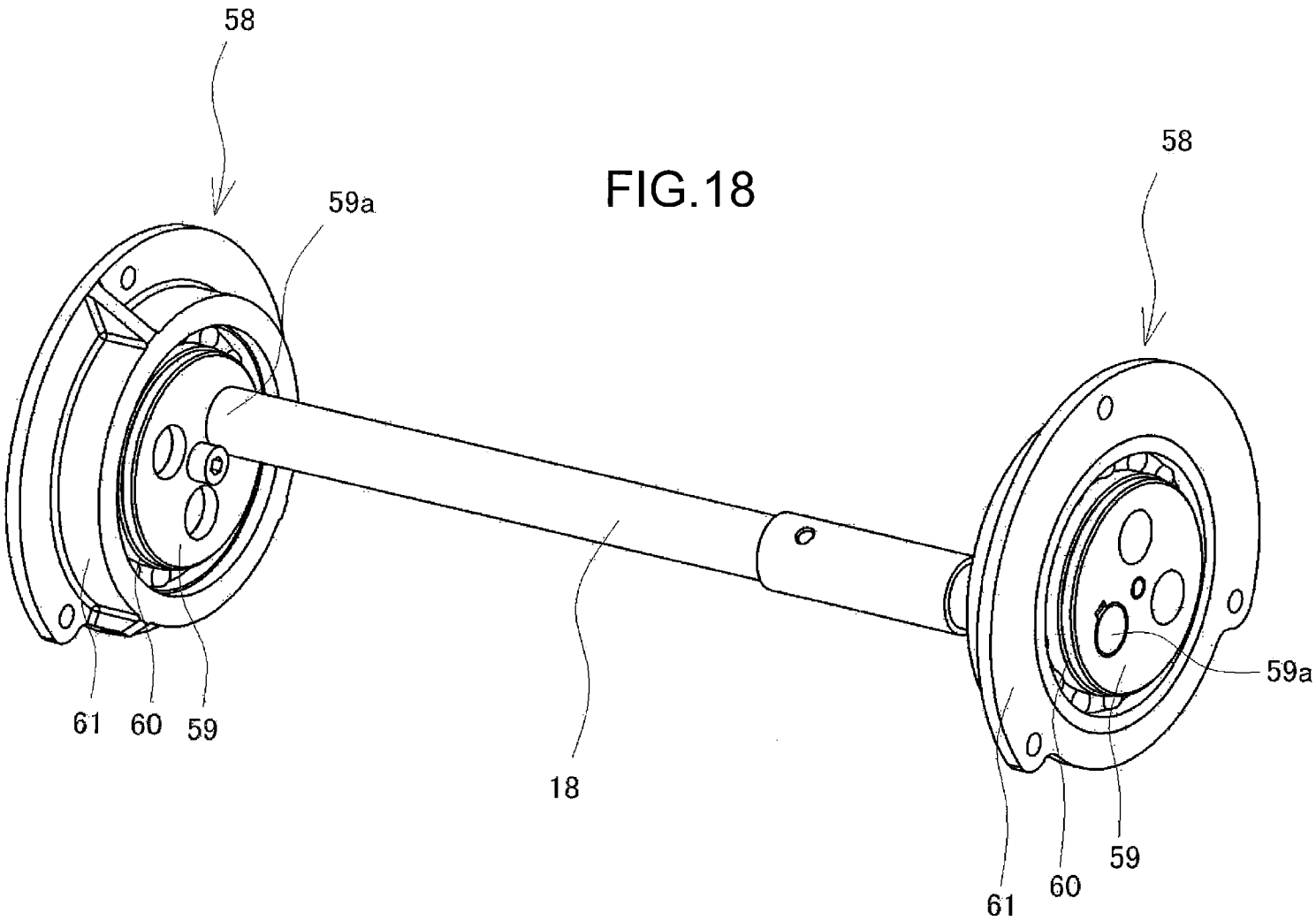
FIG. 18 is a front perspective view showing the main parts of a power transmission part of the massage machine.

Hereinafter, description will be made of the configuration of the massage machine M2 according to the second embodiment of the present invention with reference to FIGS. 13 to 18. The same reference numerals are used for the same configurations as those in the massage machine M1 according to the first embodiment, and the massage machine M2 provided in the armrest part 104 will be described as a representative. FIG. 13 is a front perspective view of the massage machine M2, FIG. 14 is a front perspective view of the massage machine M2 in which the massage part is omitted, FIG. 15 is a front view of the massage machine M2 in which a part of the base part 4 is omitted, FIG. 16 is a left side view of the massage machine M2, FIG. 17 is a front perspective view of the massage machine M2 in which a part of the rubbing part 2 is omitted, and FIG. 18 is a front perspective view showing the main parts of the power transmission part 8 in the massage machine M2.

[Overall Configuration of Massage Machine]

Figure 14:
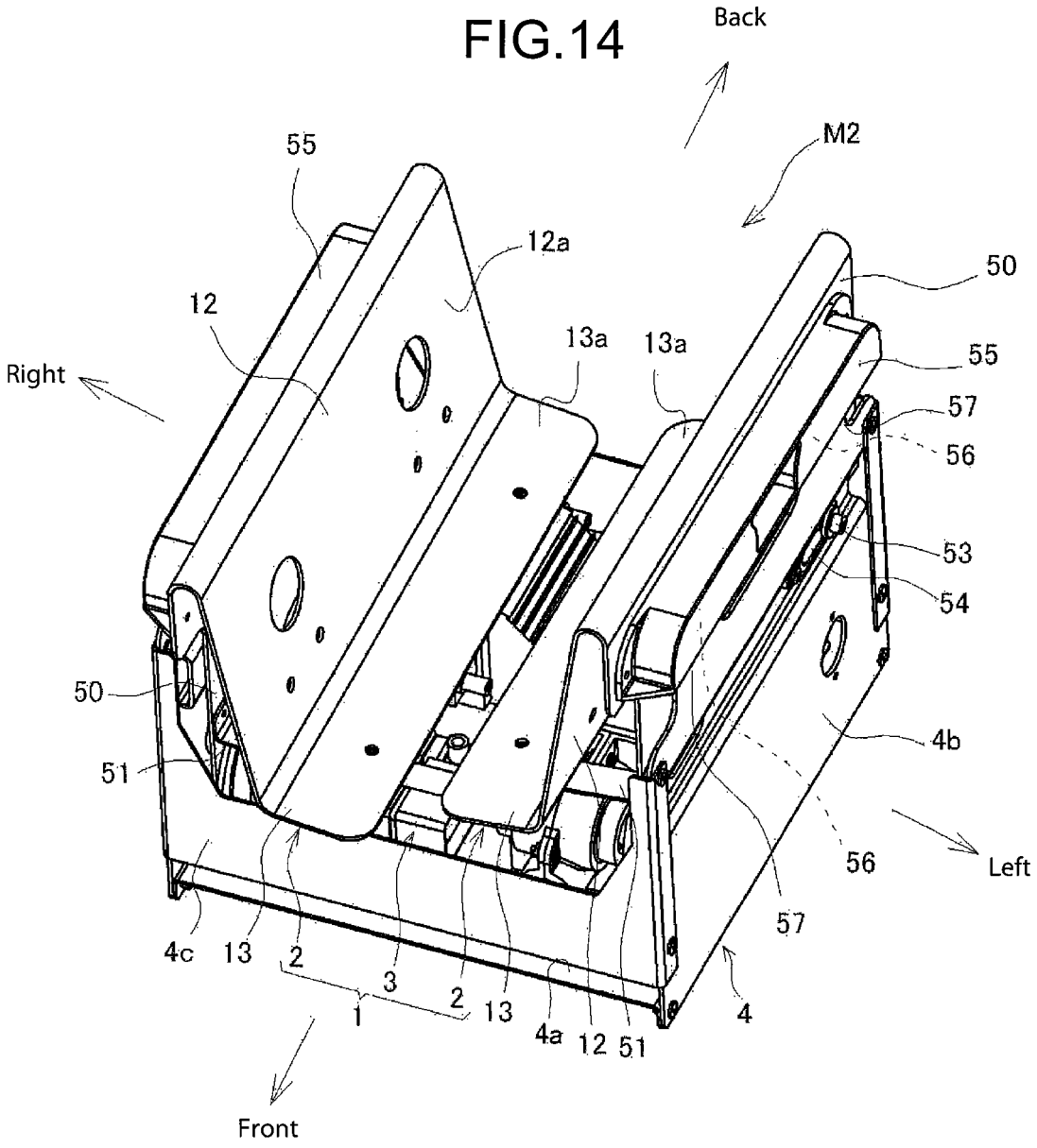
FIG. 14 is a front perspective view of the massage machine in which a massage part is omitted.
Figure 15:
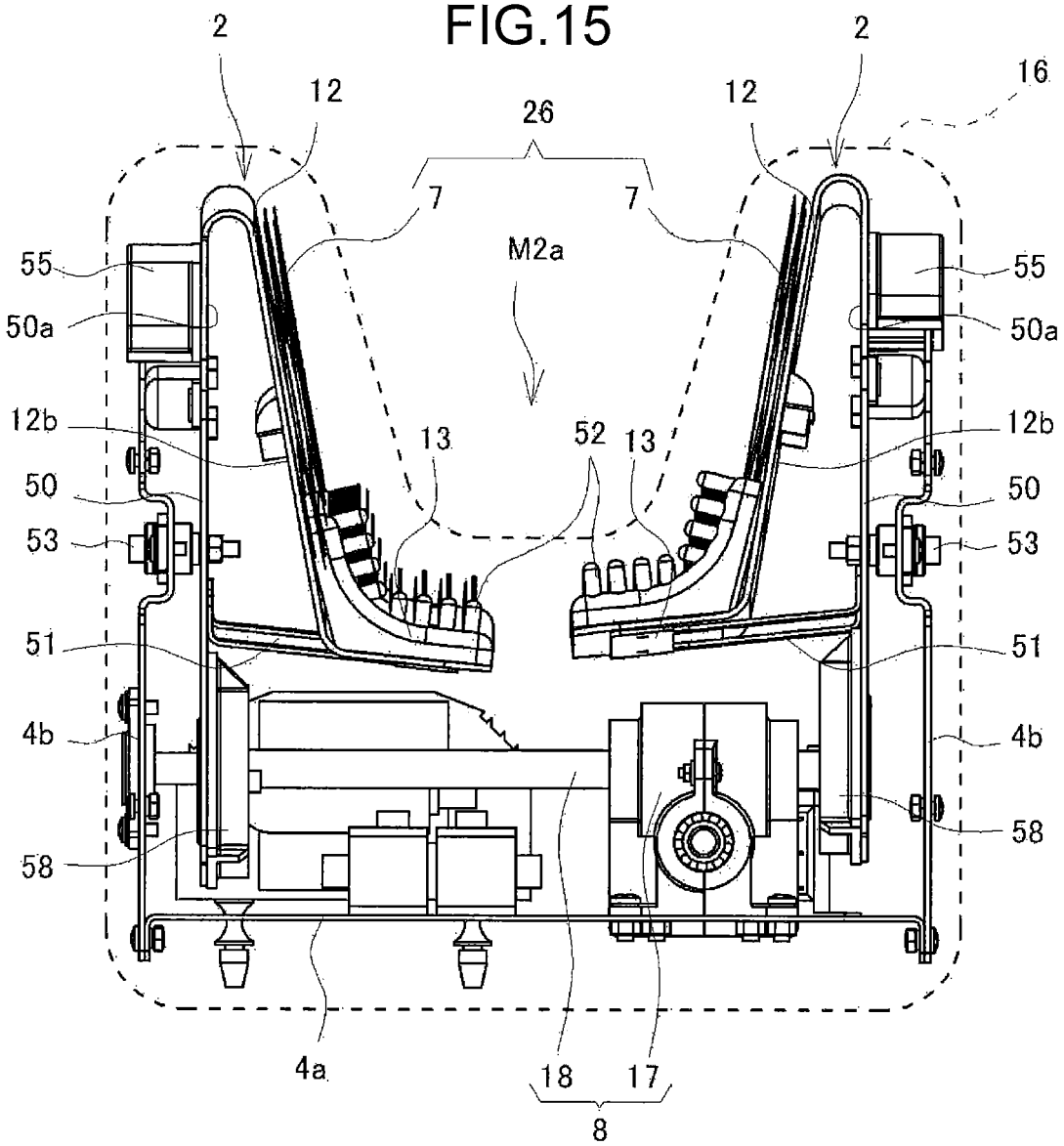
FIG. 15 is a front view of the massage machine in which a part of a base part is omitted.

As shown in FIGS. 13 to 15, the massage machine M2 is constituted by a rubbing unit 1 including rubbing parts 2 which perform a rubbing massage on each side surface of both arms of the person to be treated and a rubbing driving part 3 which drives these rubbing parts 2, and base parts 4 which are arranged on the upper surfaces of the armrest parts 104 to support the rubbing unit 1.

[Configuration of Base Part]

As shown in FIG. 17, the base part 4 has a configuration in which the upper side thereof is opened by a plate-shaped bottom portion 4*a*, plate-shaped side portions 4*b* and 4*b* provided so as to stand on both left and right sides of the bottom portion 4*a*, a plate-shaped front portion 4*c* provided so as to stand on the front side of the bottom 4*a*, and a plate-shaped back portion 4*d* provided so as to stand on the back side of the bottom portion 4*a*. The rubbing part 2 is movably supported at the left and right side portions 4*b* and 4*b* of the base part 4 through a power transmission part 8 which will be described later. In addition, the power transmission part 8 and the rubbing driving source 9 constituted by a motor and the like which drives the rubbing part 2 through the power transmission part 8 are supported at the bottom portion 4*a* of the base part 4. In addition, guide holes 54 and 54 which open in the horizontal direction of the longer dimension are provided at the other end side (the back end portion in this embodiment) of both side portions 4*b* and 4*b* of the base part 4 in the longitudinal direction of the arms so as to restrict the rotation movement of the rubbing part 2, which will be described later.

[Configuration of Rubbing Part]

As shown in FIGS. 13 to 15, the rubbing part 2 is constituted by a plate-shaped coupling part 50 which is supported by the base part 4 through the power transmission part 8 and coupled to the power transmission part 8 so as to be able to be displaced in the vertical and the front-back directions, a plate-shaped first rubbing part 12 which is supported by the coupling part 50 and includes a facing inner side surface 12*a* facing the outer surface of the arm, and a plate-shaped second rubbing part 13 which is integrally configured with the first rubbing part 12, provided so as to extend from the lower end portion of the first rubbing part 12 to the horizontal inner side, and includes a facing inner bottom surface 13*a* facing the back surface of the arm, where a pair of left and right rubbing part 2 is provided at both side portions 46 and 46 of the base part 4.

The first rubbing parts 12 and 12 and the second rubbing parts 13 and 13 included in the pair of left and right rubbing parts 2 constitute a recessed portion M2*a* for containing the arm, which opens at the upper side thereof and the both ends in the front-back direction, and both side surfaces of the arm contained in this recessed portion M2*a* are supported by the first rubbing parts 12 and 12 while the back surface of the arm is supported by the second rubbing parts 13 and 13.

As shown in FIGS. 14 and 15, the first rubbing part 12 has a substantially rectangular shape when viewed from the side with a longer dimension along the front-back direction (the longitudinal direction of the arms), and the facing inner surface 12*a* of the first rubbing part 12 is an inclined surface in which the lower end side is slightly inclined inwardly. In addition, the first rubbing part 12 has air cells 7 which press the external surface of the arm of the person to be treated, which will be described later, and a plurality of air cells 7 is provided in the facing inner side surfaces 12*a* of the first rubbing part 12 along the front-back direction (the longitudinal direction of the arms). The air cells 7 are connected to the air supply/discharge apparatus 5 through the air piping (not shown) so as to be able to expand and contract by the supply and discharge of the air.

As shown in FIGS. 14 and 15, the second rubbing part 13 has a substantially rectangular shape when viewed from the upper side with a longer dimension along the front-back direction (the longitudinal direction of the arms), the facing inner bottom surface 13*a* of the second rubbing part 13 is an inclined surface in which the inner end side is slightly inclined downwardly, and each of the pair of left and right second rubbing parts 13 and 13 is arranged so as to be close to each other such that the arm does not fall into the space between both second rubbing parts 13 and 13. In addition, the second rubbing part 13 includes a reinforcing part 51 which is provided in the external bottom surface 13*b* as the rear side surface of the facing inner bottom surface 13*a* of the second rubbing part 13 and couples the second rubbing part 13 and the coupling part 50 to resist the load on the arms. In addition, the second rubbing part 13 includes a treatment protrusion 52 which applies shiatsu from the back surface to the side surface of the arm, and this treatment protrusion 52 is provided in the facing inner bottom surface 13*a* of the second rubbing part 13 so as to have a configuration with a sheet shape made of synthetic resin or the like with a longer dimension along the longitudinal direction of the arms to the extent to which the lower portion of the facing inner side surface 12*a* of the first rubbing part 12 and the facing inner bottom surface 13*a* of the second rubbing part 13 are covered.

As shown in FIG. 15, the pair of left and right rubbing parts 2 and 2 is integrally covered with the cover part 16 with a surface constituted by a cloth or the like with the stretch surface so as to prevent the rubbing parts 2 from being exposed to the outside and reduce the risk of the arm being trapped between both second rubbing parts 13 and 13.

As shown in FIGS. 15 to 17, the coupling part 50 is configured to have a plate shape with an inner surface 50*a* facing the external surface 12*b* as the back side surface of the facing inner side surface 12*a* of the first rubbing part 12, and the power transmission part 8 which causes the rubbing part 2 to act, which will be described later, is coupled to the coupling part 50 at the front end lower portion thereof from the inner side surface 50*a*. In addition, a rod-shaped guide shaft 53 which protrudes outwardly from the external side surface 50*b* is provided at the back end portion of the coupling part 50, and this guide shaft 53 is inserted into the guide hole 54 which is provided in the side portion 4*b* of the base part 4 and includes an opening with a longer dimension in the longitudinal direction of the arms. The guide shaft 53 can be relatively displaced in the front-back direction along the longitudinal direction of the guide hole 54 and is rotatably supported with respect to the guide hole 54.

As shown in FIG. 16, the coupling part 50 includes a restriction part 55 which restricts the displacement of the base part 4 in the horizontal direction (the direction perpendicular to the side surface of the arm), and this restriction part 55 is provided in the upper end portion of the coupling part 50. Since the restriction part 55 has a similarly longer dimension as that of the coupling part 50 in the front-back direction, the restriction part 55 has a longer dimension in the front-back direction (the longitudinal direction of the leg) and further a predetermined thickness in the horizontal direction, and is provided with a pair of front and back guide holes 56, which opens in the vertical direction, in the lower portion of the restriction portion 55. A pair of front and back guide protrusions 57 which is included in the side portion 4*b* of the base part 4 and protrudes upwardly is inserted in the guide holes 56 from the lower side, and the guide protrusions 57 are substantially mound-shaped in which the center in the front-back direction protrudes upwardly as compared with both end portions. Since the linear dimension of the guide hole 56 in the front-back direction is maintained to be greater than the linear dimension of the guide protrusion 57 in the front-back direction, the displacement of the coupling part 50 with respect to the base part 4 is allowed in the front-back direction and vertical direction while restricted in the horizontal direction.

[Configuration of Rubbing Driving Part]

Hereinafter, description will be made of a configuration of the rubbing driving part 3 with reference to FIGS. 17 and 18.

As shown in FIGS. 17 and 18, the rubbing driving part 3 includes a rubbing driving source 9 such as a motor and the like driven by the control part 6 and a power transmission part 8 which transmits the rotation power of the rubbing driving source 9 to cause the rubbing part 2 to act, and the rubbing driving part 3 is provided in the base part 4. The output axis of the rubbing driving source 9 is provided along the front-back direction (the longitudinal direction of the arms), and the power transmission part 8 includes a gear case 17 with a worm gear to change the rotation direction of the output axis of the rubbing driving source 9 for deceleration, a transmission shaft 18 which is connected to this worm gear and rotated about an axial center directed towards the horizontal direction (the width direction of the arms), and a shaft support part 58 which supports both left and right end portions of the transmission shaft 18 at the rubbing part 2. This transmission shaft 18 is rotatably supported on the one end side (the front end portion in this embodiment) in the front-back direction of the base part 4. In this embodiment, the rubbing driving source 9 is constituted by a motor, and the rotation direction and the rotation speed of the output axis thereof are configured to be variable by the control part 6.

The shaft support part 58 includes an eccentric cam 59 attached to the transmission shaft 18, which will be described later, a bearing 60 provided in the outer circumferential portion of the eccentric cam 59, and a holder 61 which attaches the eccentric cam 59 to the coupling part 50 included in the rubbing part 2 through the bearing 60. A pair of left and right eccentric cams 59 and 59 which causes the rubbing part 2 to act is provided in both the left and right end portions of this transmission shaft 18, and the eccentric cam 59 is attached to the transmission shaft 18 so as to be integrally rotatable with the transmission shaft 18.

Such eccentric cams 59 have disk shapes with a thickness in the horizontal direction, and a rotation axis center 59*a* is provided at a position distant from the center of the geometric circle of the outer shape such that the left and right end portions of the transmission shaft 18 coincide with the rotation axis centers 59*a* and 59*a* of the pair of left and right eccentric cams 59 and 59. A ring-shaped bearing 60 is externally fitted onto the outer circumferential portion of the eccentric cam 59 such that the eccentric cams 59 are rotatably supported by the holders 61 through the bearings 60, and the holders 61 are attached to the inner surfaces 50*a* and 50*a* of the coupling portions 50 and 50 included in each rubbing part by a coupling means (not shown) such as a bolt or the like. In addition, each of the pair of left and right eccentric cams 59 and 59 has mutually different phases with respect to the rotation axis center 59*a*. In the second embodiment, the phases of the pair of left and right eccentric cams 59 and 59 with respect to the rotation axis center 59*a* are different from each other by 180°.

[Configuration of Massage Part]

Hereinafter, description will be made of the configuration of the massage part included in the rubbing part 2 with reference to FIG. 13.

As shown in FIG. 13, an air cell 7 which expands and contracts due to the supply and the discharge of the air is employed as the massage part in this embodiment, which performs a massage on the body part of the person to be treated. The air cells 7 are provided in the facing inner surfaces 12*a* and 12*a* of the pair of left and right first rubbing parts 12 and 12, have substantially flat shapes in the side view during the contraction, and are expanded inwardly in the horizontal direction during the expansion when air is supplied from the air supply/discharge apparatus 5. In addition, it is also applicable that these air cells 7 have an undevelopable base part with a lower portion attached to the facing inner surfaces 12*a* of the first rubbing parts 12 and a developing part with an upper portion which can be developed inwardly in the horizontal direction such that these air cells 7 have substantially flat shapes in the side view during the contraction and the developing part is expanded and developed inwardly in the horizontal direction in an accordion-like manner with respect to the base part during the expansion when air is supplied from the air supply/discharge apparatus 5.

The air cell group 26 which presses the both side surfaces of the arms is constituted by the pair of left and right air cells 7, a plurality of air cell groups 26L and 26R is provided in the front-back direction (the longitudinal direction of the legs), and it is possible to press both legs with the plurality of air cell groups 26L and 26R in accordance with the change in thickness of the legs in the longitudinal direction. Accordingly, when the air supply/discharge apparatus 5 is driven by the output signal from the control part 6, and air is supplied to the plurality of air cell groups 26, the pressing massage is performed on the arms due to the expansion of the air cells 7, and the intervals of the recessed portions M2*a* which contain the arms are adjusted to the intervals corresponding to the size of the arms of the person to be treated.

[Actions of Rubbing Part]

Figure 19:
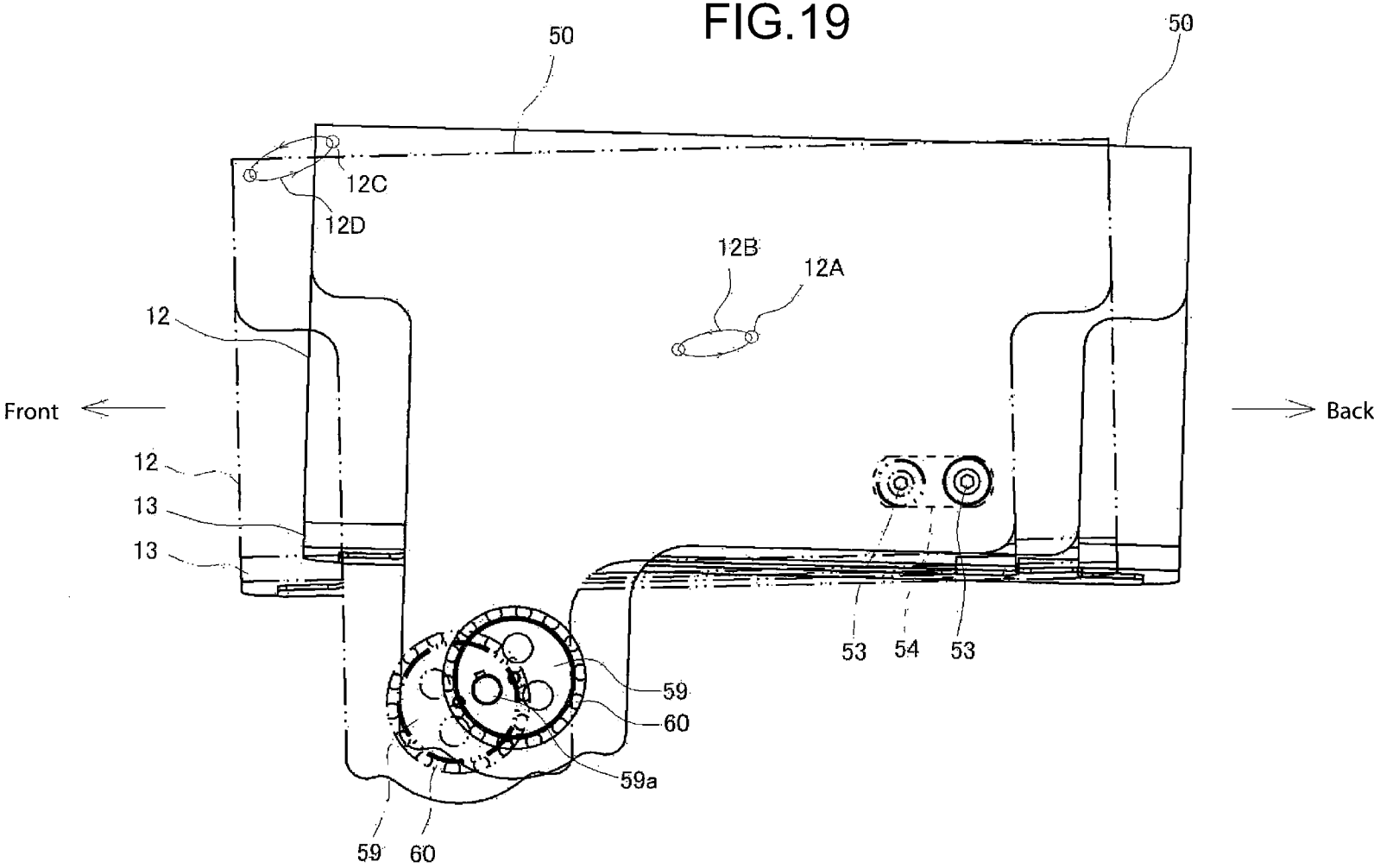
FIG. 19 is a left side view showing the main parts of the rubbing part of the massage machine for illustrating the actions of the rubbing part.

Hereinafter, description will be made of the actions of the rubbing part 2 with reference to FIG. 19. FIG. 19 is a left side view showing the main parts of the rubbing part 2 of the massage machine M2, which illustrates the actions of the rubbing part 2.

When the rubbing driving source 9 is driven, and the output shaft of the rubbing driving part 3 with the aforementioned configuration is rotated, the transmission shaft 18 provided on one end side (the front end portion in this embodiment) in the front-back direction of the base part 4 is rotated about the axial center in conjunction with the rotation of the output shaft through the gear case 17, and the eccentric cams 59 and 59 attached to both the left and right end portions of the transmission shaft 18 revolves about the rotation axis center of the transmission shaft 18. Then, the holder 61 provided in the lower portion on the one end side in the front-back direction of the coupling part 50 that supports the eccentric cam 59 is made to perform a circular movement along the revolution track of the eccentric cam 59 due to the revolution of the eccentric cam 59. On the other hand, since the guide shaft 53 provided on the other end side in the front-back direction of the coupling part 50 is inserted into the guide holes 54 and 54 provided in both sides 4*b* and 4*b* of the base part 4, the circular movement of the coupling part 50 itself is restricted regardless of the circular movement of the holder 61. As a result, the coupling part 50 is reciprocated once in the front-back direction by a predetermined distance and performs an orbiting action for inclination in the front-back direction while the transmission shaft 18 is rotated once. Accordingly, the rubbing part 2 performs the orbiting action for the inclination in the front-back direction during one reciprocation in the front-back direction by the predetermined distance along with the aforementioned action.

At this time, a fixed point 12A positioned substantially at the center of the first rubbing part 12 included in the rubbing part 2 in the side view orbits along a substantially oval-shaped track 12B with a longer dimension in the front-back direction while a fixed point 12C positioned at the back portion of the upper end of the first rubbing part orbits along a substantially oval-shaped track 12D with a longer dimension than that of the track of the fixed point 12A. In addition, since the second rubbing part 13 included in the rubbing part 2 is integrally configured with the first rubbing part 12, the second rubbing part 13 performs an orbiting action for inclination in the front-back direction while being reciprocated once in the front-back direction by a predetermined distance in conjunction with the orbiting of the first rubbing part 12. Moreover, the rubbing driving source 9 of the rubbing driving part 3 is electrically connected to the control part 6 through a drive circuit (not shown), and the action thereof is controlled by an electric signal output from the drive circuit based on the control signal from the control part 6.

Incidentally, each of the pair of left and right eccentric cams 59 and 59 has phases which are different from each other by 180° as described above. Accordingly, the phases of the pair of left and right orbiting rubbing parts 2 and 2 are different from each other by 180°, and therefore, the rubbing parts 2 and 2 are displaced in opposite directions. That is, one rubbing part 2 is displaced to one side (front side) in the front-back direction while the other rubbing part 2 is displaced to the other side (back side) in the front-back direction, and one end side (front end portion) of the one rubbing part 2 in the front-back direction is displaced to one side (upward) in the vertical direction and the other end side (back end portion) in the front-back direction is displaced to the other side (downward) in the vertical direction while one end side (front end portion) of the other rubbing part 2 in the front-back direction is displaced to the other side (downward) in the vertical direction and one end side (back end portion) in the front-back direction is displaced to the other side (upward) in the vertical direction.

[Treatment Pattern]

The massage machine M2 according to the second embodiment can execute the same treatment patterns 1 to 6 as those in the aforementioned massage machine M1 according to the first embodiment.

[Other Embodiments of Massage Machine]

The aforementioned massage machines M1 and M2 according to the first and second embodiments are not limited to the configurations shown in the drawing and may be differently configured within the scope of the present invention. Although description will be made hereinafter of a case in which other embodiments of the massage machines M1 and M2 are applied to the massage machine M1 as a representative, the application can also be made for the massage machine M2 according to the second embodiment in the same manner.

Although FIG. 1 shows the massage machine M1 with the configuration applied to the chair type massage machine 100, it is also possible to configure the massage machine M1 to be mounted on the mounting surface such as a floor surface or the like and used in an independent state from the chair type massage machine 100. In such a case, the air supply/discharge apparatus 5 and the control part 6 are arranged on the bottom portion 4*a* or the like of the base part 4. In a configuration in which this massage machine M1 is used in an independent state from the chair-type massage machine 100, it is possible to provide an angle adjustment mechanism 190 which changes the angle between the bottom portion 4*a* of the base part 4 and the mounting surface F such as a floor surface or the like on which the massage machine M1 is mounted. Hereinafter, description will be made of this angle adjustment mechanism 190 with reference to FIG. 20. FIG. 20(*a*) is a back perspective view of the massage machine M1, which illustrates one example of the angle adjustment mechanism 190, and FIG. 20(*b*) is a left side view of the massage machine M1, which illustrates another example of the angle adjustment mechanism 190.

As shown in FIG. 20(*a*), one example of the angle adjustment mechanism 190 is constituted by a support part 200 which is rotatably coupled to the other end portion (back end portion) of the base part 4 in the front-back direction. This support part 200 includes a pair of left and right side portions 200*a* and 200*a* which is rotatably supported by both side portions 4*b* and 4*b* of the base part 4 through the rotation axis 201 in the horizontal direction and has a longer length in the front-back direction in a state in which the bottom portion 4*a* of the base part 4 is grounded on the mounting surface F and a coupling portion 200*b* which couples the one end portion (front end portion) in the front back direction, can be grounded on the mounting surface F, and has a longer length in the horizontal direction, where both side portions 200*a* and 200*a* and the coupling portion 200*b* are integrally configured. In a state in which the bottom portion 4*a* is grounded on the mounting surface F, the both side portions 200*a* and 200*a* of the support part 200 are respectively positioned outside both side portions 4*b* and 4*b* of the base part 4, and the coupling portion 200*b* of the support part 200 is positioned in front of the front portion 4*c* of the base part 4. It is possible to change the angle between the bottom portion 4*a* of the base part 4 and the mounting surface F by rotating backward (in the direction of an arrow c) the other end portion (back end portion) of the support part 200 in the front-back direction from a state shown by a solid line to a state shown by a two-dot chain line in FIG. 20(*a*) and causing the coupling portion 200*b* to be grounded on the mounting surface F. In addition, it is possible to position the support part 200 at an arbitrary position between the state shown by the solid line to the state shown by the two-dot chain line in FIG. 20(*a*) and to arbitrarily change the angle between the bottom portion 4*a* of the base part 4 and the mounting surface F by providing a lock mechanism (not show) which locks the rotation of this support part 200.

As shown in FIG. 20(*b*), another example of the angle adjustment mechanism 190 is configured by a base support part 202 which supports the base part 4 and an air cell 203 interposed between the bottom portion 4*a* of the base part 4 and the base support part 202. This base support part 202 is configured to have a plate shape with surfaces in the vertical direction such that the bottom portion 4*a* of the base part 4 can be mounted on the upper surface 202*a* while the lower surface 202*b* can be grounded on the mounting surface F, and one end portion (front end portion) of the base part 4 in the front-back direction is rotatably supported by the one end portion (front end portion) of the base support part 202 in the front-back direction through the rotation axis 204 in the horizontal direction. The air cell 203 is provided on the upper surface 202*a* of the base support part 202 and has a substantially flat shape during the contraction as shown by the solid line, and the other end portion (the back end portion in the front-back direction) is developed in a fan shape during the expansion as shown by the two-dot chain line. Accordingly, it is possible to arbitrarily change the angle between the bottom portion 4*a* of the base part 4 and the base support part 202 (that is, the mounting surface F) by appropriately adjusting the level of expansion of the air-cell 203. In addition, the expansion and the contraction of the air cell 203 is performed by the supply and the discharge of the air by the aforementioned air supply/discharge apparatus 5.

In addition, although the air cell 7 included in the massage machine M1 is configured to be arranged only in the facing inner surface 12*a* of the first rubbing part 12 included in the external rubbing part 10 and in the facing inner surfaces 14*a* and 14*a* of the first rubbing part 14 included in the intermediate rubbing part 11, the air cell 7 may also be arranged in the facing inner bottom surface 13*a* of the second rubbing part 13 included in the external rubbing part 10 and/or in the facing inner bottom surfaces 15*a* and 15*a* of the second rubbing part 15 included in the intermediate rubbing part 11. In addition, another configuration is also applicable in which the air cell 7 is only provided to a facing inner surface of either one of the first rubbing part 12 and the first rubbing part 14.

Figure 21:
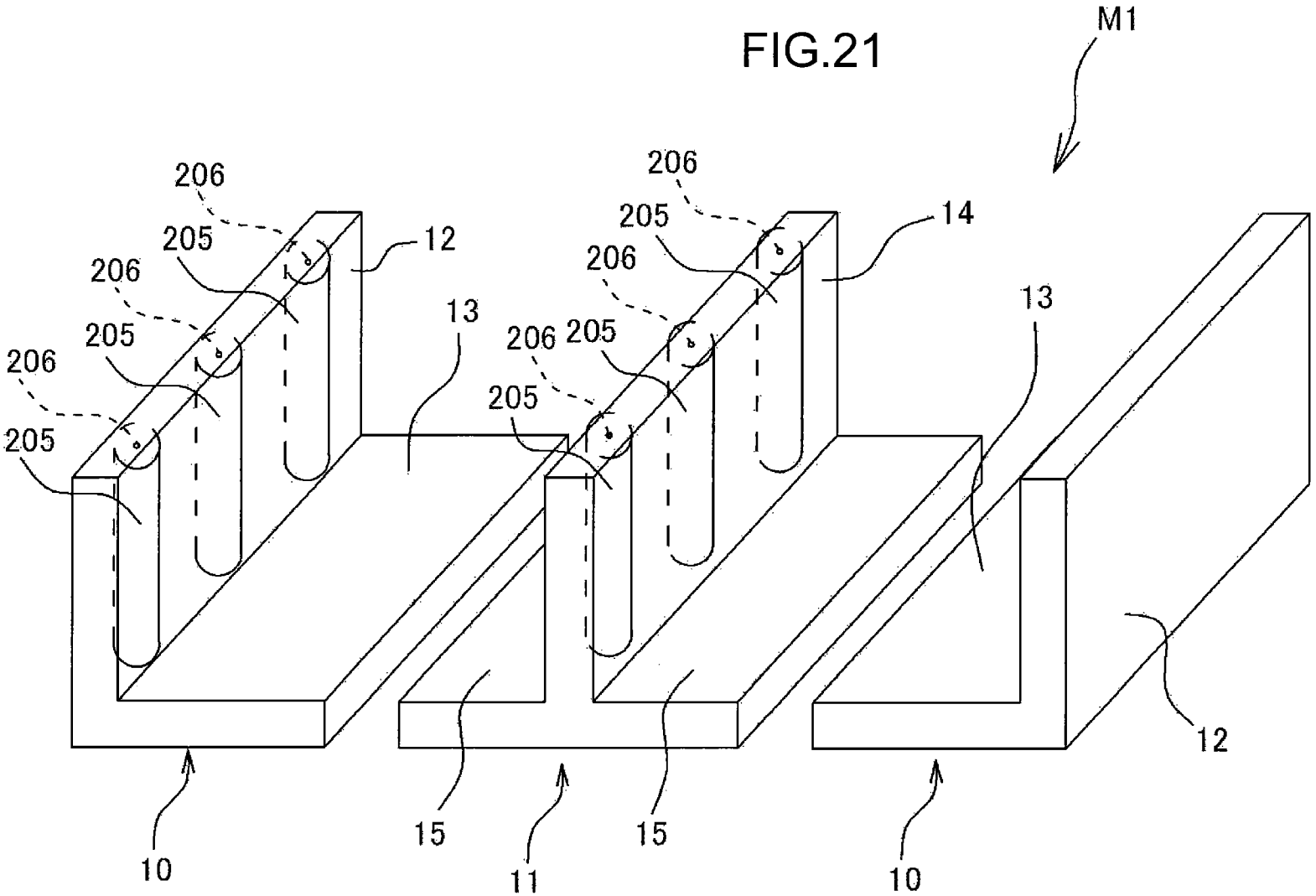
FIG. 21 is a front perspective view of the massage machine for illustrating other configurations of the massage part.

In addition, the massage part included in the rubbing part 2 may have a configuration other than the air cell 7. Hereinafter, description will be made of another configuration of the massage part with reference to FIG. 21. FIG. 21 is a front perspective view of the massage machine M1, which illustrates another configuration of the massage machine.

As shown in FIG. 21, rollers 205 which are rotated and moved on the side surface of a body part (legs) of a person to be treated are provided in the facing inner surfaces 12*a* and 14*a* of the first rubbing part 12 and 14 instead of the air cells 7 provided in the first rubbing parts 12 and 14. The roller 205 includes a rotation axis 206 extending in the vertical direction, and rotates in the front-back direction (the longitudinal direction of the body part) such that a contact surface 205*a* of the roller 205 to the body part rubs the side surface of the body part by the orbiting action of the rubbing part 2. In addition, a plurality of rollers 205 is provided along the front-back direction.

Moreover, it is needless to say that the rollers 205 can also be provided in the facing inner bottom surfaces 13*a* and 15*a* of the second rubbing parts 13 and 15, and the roller 205 has a rotation axis extending in the horizontal direction and rotates in the front-back direction (the longitudinal direction of the body part), and the contact surface of the roller to the body part rubs the back surface of the body part by the orbiting action of the rubbing part 2 when the rollers 205 are provided in the second rubbing parts 13 and 15.

The aforementioned rubbing massage machines M1 and M2 according to the first and second embodiments are respectively provided with a strength adjustment part 70 which adjusts the pressing force of the air cell 7 to the body part of the person to be treated. Hereinafter, description will be made of the configurations of the strength adjustment parts 70, 80, and 90 with reference to FIGS. 22 to 27. Although the following description will be made of a configuration in which the strength adjustment parts 70, 80, and 90 are provided in the rubbing massage machine M1 according to the first embodiment as a representative, it is also possible to provide the strength adjustment parts 70, 80, and 90 in the massage machine M2 according to the second embodiment in the same manner.

Figure 22:
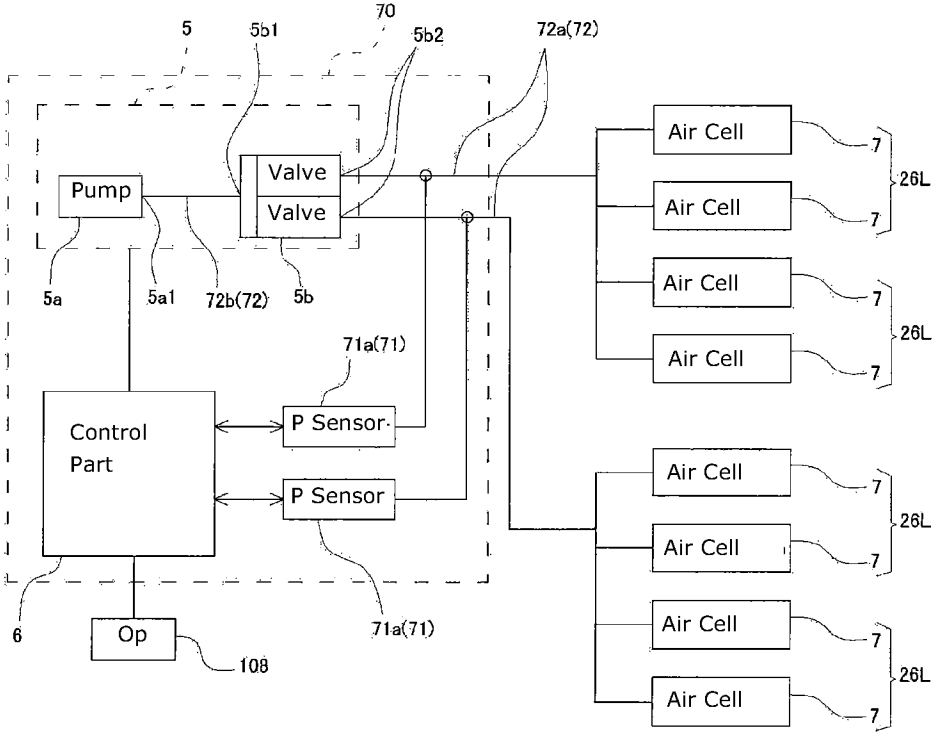
FIG. 22 is a functional block diagram of the strength adjustment part (version 1), which illustrates the configuration of a detection part according to the first embodiment.
Figure 23:
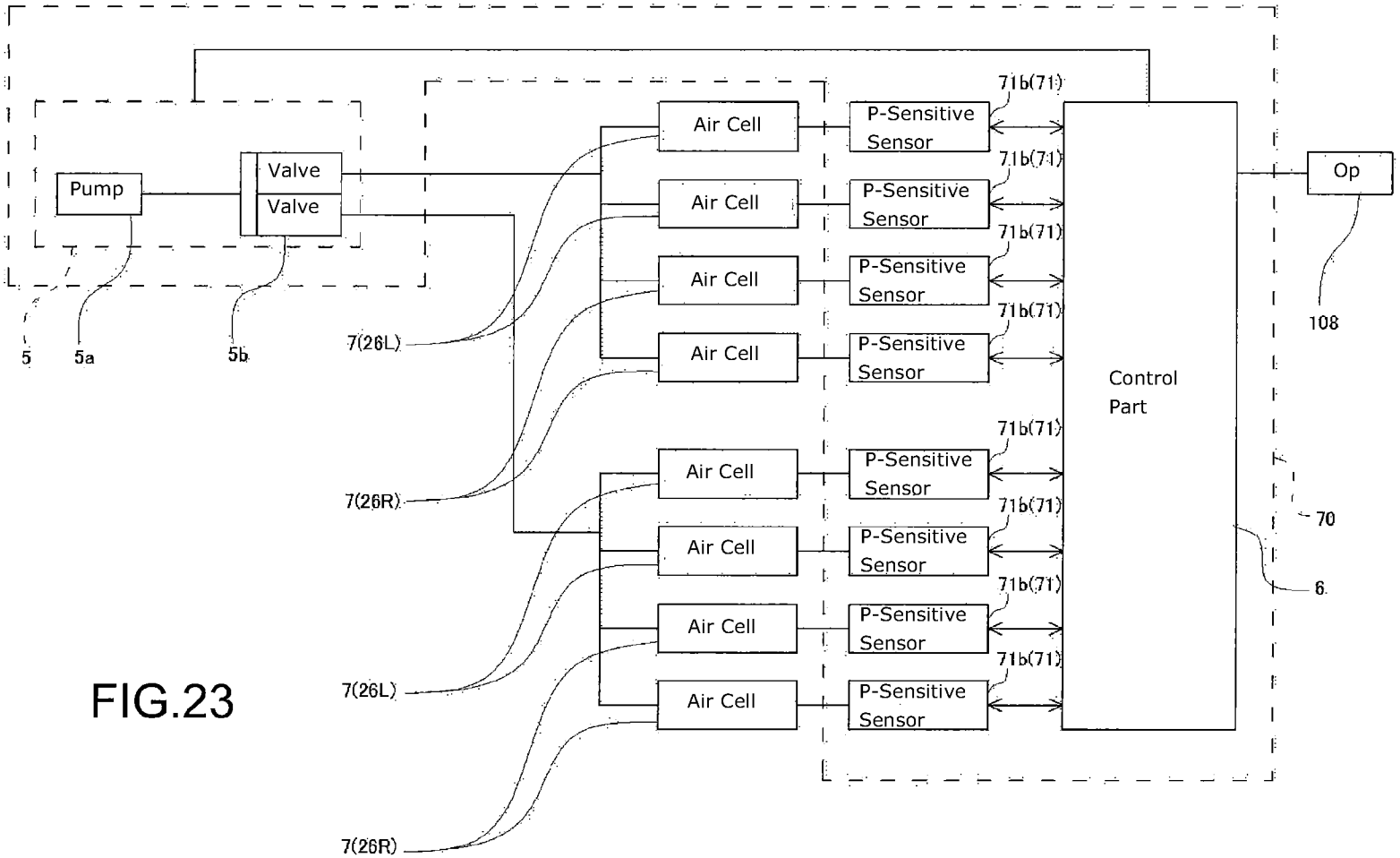
FIG. 23 is a functional block diagram of the strength adjustment part (version 1), which illustrates the configuration of the detection part according to the second embodiment.
Figure 24:
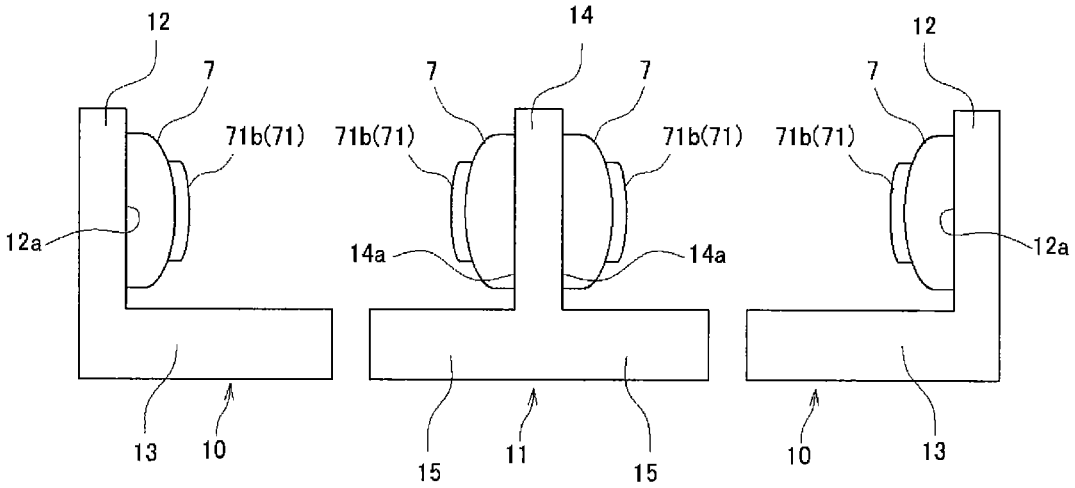
FIG. 24 is a front view schematically showing the massage machine, which illustrates the configuration of the detection part according to the second embodiment included in the strength adjustment part (version 1).
Figure 26:
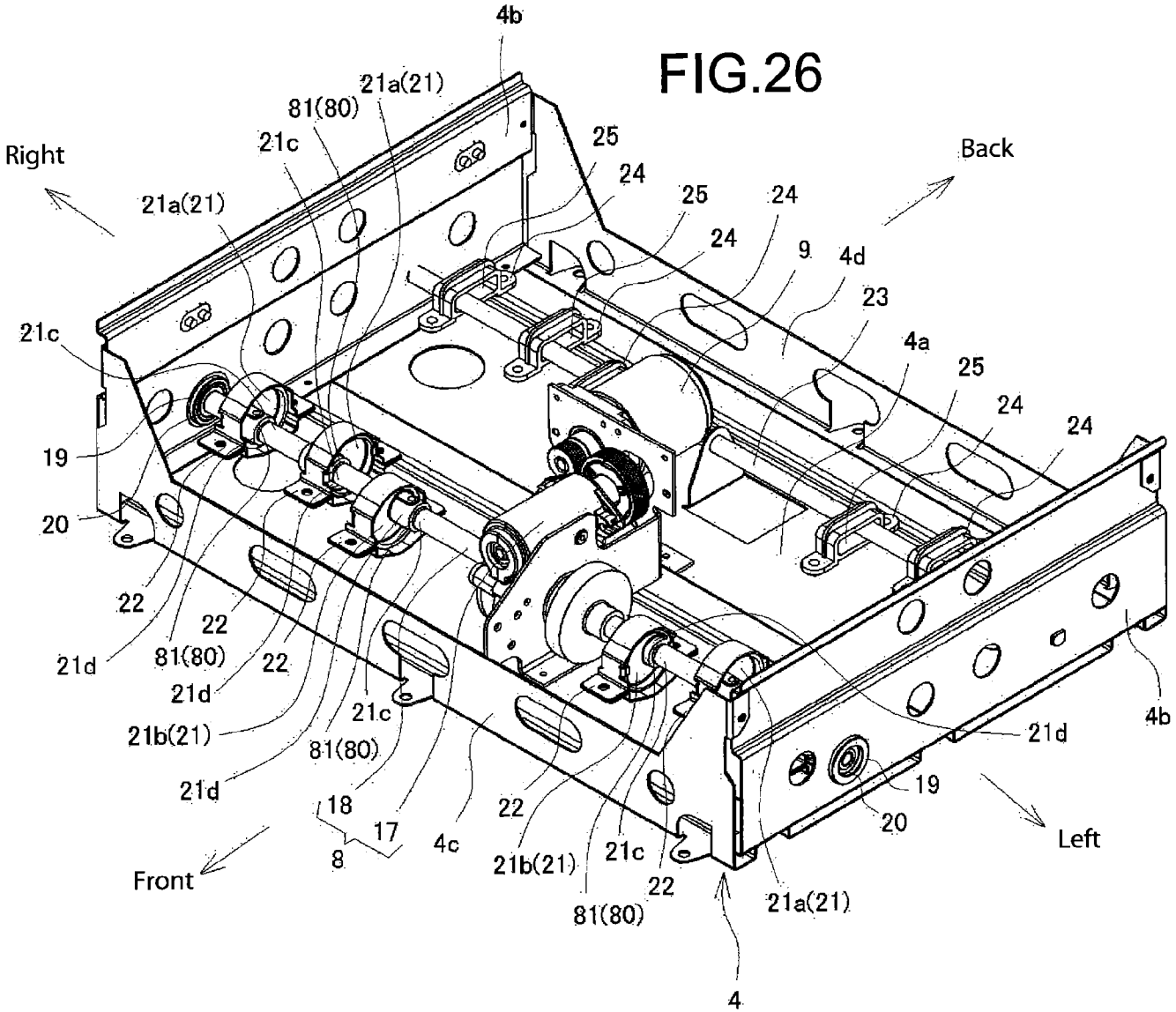
FIG. 26 is a front perspective view of the massage machine, in which the rubbing part is omitted, which illustrates the configuration of the strength adjustment part (version 2).
Figure 27:
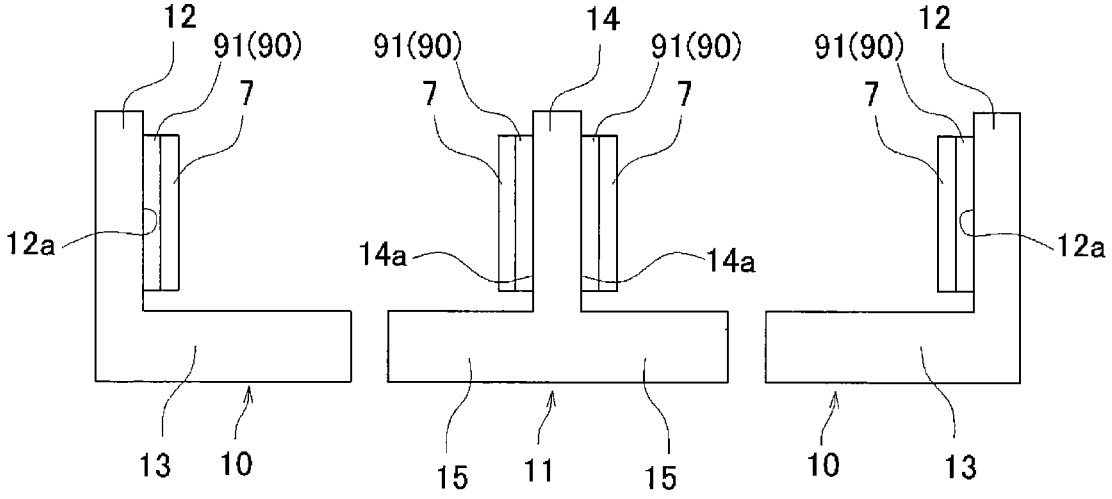
FIG. 27 is a front view schematically showing the massage machine, which illustrates the configuration of the strength adjustment part (version 3).

FIG. 22 is a functional block diagram of the strength adjustment part (version 1) 70, which illustrates the configuration of the detection part 71 according to the first embodiment. FIG. 23 is a functional block diagram of the strength adjustment part (version 2) 70, which illustrates the configuration of the detection part 71 according to the second embodiment. FIG. 24 is a front view schematically showing the massage machine M1, which illustrates the configuration of the detection part 71 according to the second embodiment included in the strength adjustment part (version 1) 70. FIG. 25(*a*) is a front view schematically showing the external rubbing part 10 of the massage machine M1 in a state in which the air cell 7 is contracted, which illustrates the configuration of the detection part 71 according to the third embodiment included in the strength adjustment part (version 1) 70. FIG. 25(*b*) is a front view schematically showing the external rubbing part 10 of the massage machine M1 in a state in which the air cell 7 is expanded, which illustrates the configuration of the detection part 71 according to the third embodiment included in the strength adjustment part (version 1) 70. FIG. 26 is a front perspective view schematically showing the massage machine M1, in which the rubbing part 2 is omitted, which illustrates the configuration of the strength adjustment part (version 2) 80. FIG. 27 is a front view of the massage machine M1, which illustrates the configuration of the strength adjustment part (version 3) 90.

[Configuration of Strength Adjustment Part (Version 1)]

As shown in FIGS. 22 and 23, the strength adjustment part (version 1) 70 is constituted by the control part 6, the air supply/discharge part 5, and the detection part 71 which detects the pressing force of the air cell 7 with respect to the body part and is configured to adjust the amount of supplied and discharged air to and from the air cell 7 based on the detection result of the detection part 71. The air supply/discharge apparatus 5 is constituted by a pump 5*a* and a valve 5*b* and connected to the valve 5*b* as an independent system from the air cell groups 26L and 26R constituted by the air cells 7 and 7 on the one end side (front side) in the front-back direction and the air cell groups 26L and 26R constituted by the air cells 7 and 7 on the other end side (back side) in the front-back direction. In addition, this valve 5*b* may be a valve constituted by a solenoid valve or the like which shifts only between the air supply state and the air discharge state or may be a valve constituted by a rotary valve or the like which can shift between the air supply state and the air discharge state and shift a plurality of air supply states at different speeds at which the air is supplied to the air cell 7, by allowing the diameter of the output port from the valve to be variable. In the memory of the control part 6 is stored a plurality of predetermined pressing forces F, and a setting is respectively made such that the "weak" pressing force corresponds to the predetermined pressing force F1, the "intermediate" pressing force corresponds to the predetermined pressing force F2, and the "strong" pressing force corresponds to the predetermined pressing force F3. This predetermined pressing force F can be set by a person to be treated operating the operation part 108 or can be automatically set based on an automatic massage program stored in the memory of the control part 6.

Here, "the pressing force F of the air cell 7 with respect to the body part, which is detected by the detection part 71" is defined by a pressure within the air cell 7 and the air piping connected to the inside of the air cell 7, the contact pressure to the outside of the air cell 7, or the amount of the air flowing inside the air cell 7 and the air piping.

As shown in FIG. 22, the detection part 71 according to the first embodiment is constituted by a pressure sensor 71*a* such as a strain gauge or the like which detects the inner pressure of the air cell 7 and the inner pressure of the air piping 72 which connects the air cell 7 and the air supply/discharge apparatus. The pressure sensor 71*a* is provided in the air piping 72*a* interposed between the air cell 7 and the valve 5*b*, and more specifically, provided independently in the air piping 72*a* interposed between the air cell groups 26L and 26R and the valve 5*b* on the front side and in the air piping 72*a* interposed between the air cell groups 26L and 26R and the valve 5*b* on the back side. Accordingly, it is possible to independently detect the pressing force of the air cell groups 26L and 26R on the front side and the pressing force of the air cell groups 26L and 26R on the back side with the pressure sensor 71*a*, and to individually control the amount of the supplied and discharged air to and from the air cell groups 26L and 26R on the front side and the amount of the supplied and discharged air to and from the air cell groups 26L and 26R on the back side based on the detection result of the pressure sensor 71*a*, and therefore, it is possible to effectively perform a massage on body parts such as arms, legs, and the like with different diameters in the longitudinal direction. In addition, the pressure sensor 71*a* may be provided in the air piping 72*b* interposed between the pump 5*a* and the valve 5*b*, and it is possible to reduce the number of the pressure sensors 71*a* in such a case. Moreover, the pressure sensor 71*a* may be integrally configured with the valve 5*b* and provided in the connection part 5*b*1 with the air piping 72*b* connected to the pump 5*a* or the connection part 5*b*2 with the air piping 72*a* connected to the air cell 7, and it is possible to downsize the strength adjustment part 70 in such a case. Furthermore, the detection part 71 may be configured by a flow rate sensor which detects the amount of air sent into the air cell 7 and provided in a discharge part 5*a*1 of the pump 5*a* or the air piping 72 in such a case.

As shown in FIG. 24, the detection part 71 according to the second invention is configured by a pressure-sensitive sensor 71*b* formed to have a flexible sheet shape, which detects the contact pressure from the body part to the air cell 7. The pressure-sensitive sensors 71*b* are provided on the contact surfaces of the air cells 7 with respect to the body part and individually provided in the air cell 7 on the front side and the air cell 7 on the back side as shown in FIG. 23. Accordingly, it is possible to individually detect the pressing force of the air cell groups 26L and 26R on the front side and the pressing force of the air cell groups 26L and 26R on the back side with the pressure-sensitive sensor 71*b* and individually control the amount of supplied and discharged air to and from the air cell groups 26L and 26R on the front side and the amount of the supplied and discharged air to and from the air cell groups 26L and 26R on the back side based on the detection result of the pressure-sensitive sensor 71*b*, and therefore, it is possible to effectively perform a massage on body parts such as legs, arms, and the like with different diameters in the longitudinal direction. In addition, this pressure-sensitive sensor 71*b* may be provided so as to be interposed between the first rubbing parts 12 and 14 and the air cell 7 (that is, in the facing inner surfaces 12*a* and 14*a* of the first rubbing parts 12 and 14). When the detection part 71 is constituted by the pressure-sensitive sensor 71*b*, it is possible to adjust to a desired pressing force regardless of the sizes (diameters) of the body parts which are different depending on the persons to be treated. In addition, the detection part 71 may be constituted by a deformation sensor which is integrally configured with the air cell 7 for detecting the deformation of the air cell 7 or may be constituted by a sweat sensor which is provided on the contact surface of the air cell 7 with respect to the body part to detect the sweating amount of the person to be treated.

As shown in FIG. 25(*a*), the detection part 71 according to the third embodiment is constituted by a potentiometer 71*c* which detects the level of the expansion of the air cell 7 in the horizontal direction. The potentiometer 71*c* is constituted by a stretch member 73 such as a wire or the like which includes one end portion coupled to the lower portion of the facing inner surface 12*a* of the first rubbing part 12 included in the external rubbing part 10 and is provided so as to extend up to the external surface 12*b* of the first rubbing part 12 over the contact surface of the air cell 7 with respect to the body part, a detected body 74 which is provided in the other end portion of the stretch member 73 so as to be displaceable in the vertical direction, and a detecting body 75 which is provided in the external surface 12*b* of the first rubbing part 12 included in the external rubbing part 10 for detecting the position (vertical position) of the detected body 74. The lower end portion of this detected body 74 is always biased downwardly by a bias part 76 such as a spring. As shown in FIG. 25(*b*), the detected body 74 coupled to the stretch member 73 is displaced upwardly against the bias force of the bias part 76 when the air cell 7 is expanded in the horizontal direction, and the detecting body 75 detects the level of the expansion of the air cell 7 by detecting the position of the detected body 74. The potentiometers 71*c* are individually provided in the air cell 7 on the front side and in the air cell 7 on the back side. Accordingly, it is possible to individually detect the pressing force of the air cell groups 26L and 26R on the front side and the pressing force of the air cell groups 26L and 26R on the back side with the potentiometer 71*c* and individually control the amount of the supplied and discharged air to and from the air cell groups 26L and 26R on the front side and the amount of the supplied and discharged air to and from the air cell groups 26L and 26R on the back side based on the detection result of the potentiometer 71*c*, and therefore, it is possible to effectively perform a massage on body parts such as legs, arms, and the like with different diameters in the longitudinal direction.

The strength adjustment part 70 including the detection part 71 according to the embodiments 1 to 3 controls the air supply/discharge apparatus 5 so as to achieve the set predetermined pressing force F and adjusts the amount of the supplied and discharged air to and from the air cell 7. Specifically, the control part 6 continues the detection of the pressing force with the detection part 71 for a predetermined time period, performs the supply and the discharge of the air to and from the air cell 7 until the average value of the pressing force detected by the detection part 71 in the predetermined time period reaches the set predetermined pressing force F, stops the supply and the discharge of the air after the elapse of the predetermined time period, and controls the air supply/discharge apparatus 5 so as to maintain the predetermined pressing force F of the air cell 7. With such a configuration, it is possible to set the air cell 7 to have a desired pressing force even when the rubbing part 2 is acting while the position of the air cell 7 with respect to the body part of the person to be treated is changed during the action of the rubbing part 2 by the rubbing driving part 3.

[Configuration of Strength Adjustment Part (Version 2)]

As shown in FIG. 26, the strength adjustment part (version 2) 80 is configured by a width adjustment means for changing the position of the rubbing part 2 in the horizontal direction and adjusting the interval of the recessed portion M1*a* (see FIG. 4) in the horizontal direction, and the width adjustment means is configured by a positioning part 81 which displaces the eccentric cam 21 supported by the transmission shaft 18 in the axial direction (the horizontal direction) of the transmission shaft 18 and positions the eccentric cam at an arbitrary position in the axial direction of the transmission shaft 18. This positioning part 81 is configured by a slide bush made of an elastic member such as rubber or the like, which is fitted into the through hole 21*d* of the eccentric cam 21 so as to be able to slide and position the rubbing part 2 with respect to the transmission shaft 18 through the eccentric cam 21.

[Configuration of Strength Adjustment Part (Version 3)]

As shown in FIG. 27, the strength adjustment part (version 3) 90 is configured by a width adjustment means for changing the position of the air cell 7 in the horizontal direction and adjusting the interval between the air cell 7 provided in the first rubbing part 12 included in the external rubbing part 10 and the air cell 7 provided in the first rubbing part 14 included in the intermediate rubbing part 11 in the horizontal direction, and the width adjustment means is configured by an air cell 91 for width adjustment interposed between the air cell 7 as the massage part and the first rubbing parts 12 and 14. This air cell 91 for width adjustment is provided in the facing inner surfaces 12*a* and 14*a* of the first rubbing parts 12 and 14 included in the pair of external rubbing parts 10 and 10 and the intermediate rubbing part 11 in the same manner as the air cell 7 as the massage part, has a substantially flat shape in the side view during the contraction, and expands inwardly in the horizontal direction during the expansion when the air is supplied from the air supply/discharge apparatus 5. In addition, this air cell 91 for width adjustment may include an undevelopable base part whose lower portion is attached to the facing inner surfaces 12*a* and 14*a* of the first rubbing parts 12 and 14 and a developing part whose upper portion can be developed inwardly in the horizontal direction, have a substantially flat shape in the side view during the contraction, and the developing part may be expanded and developed inwardly in the horizontal direction in an accordion-like manner with respect to the base part during the expansion when air is supplied from the air supply/discharge apparatus 5. This air cell 91 for width adjustment and the air cell 7 are connected to the valve 5*b* as independent systems.

INDUSTRIAL APPLICABILITY

The present invention can be applied to a massage machine capable of individually performing a rubbing action and a pressing action at different positions on the back surface of a body part of a person to be treated while performing a rubbing action on the side surface of the body part.

REFERENCE SIGNS LIST

1: rubbing unit
2: rubbing part
3: rubbing driving part
4: base part
7: massage part (air cell)
8: power transmission part
9: rubbing driving source
10: external rubbing part
11: intermediate rubbing part
12, 14: first rubbing part
13, 15: second rubbing part
50: restriction part
70, 80, 90: strength adjustment part
71: detection part
81: positioning part

91: air cell for width adjustment
100: chair type massage machine
101: seat part
102: backrest part
103: footrest
104: armrest part
190: angle adjustment mechanism
205: massage part (roller)
D1, D2, D3, D4: predetermined dimension
M1, M2: massage machine
M1*a*, M2*a*: recessed portion

The invention claimed is:

1. A massage machine comprising:

a rubbing unit including a pair of rubbing parts that can perform rubbing massage on a body part of a person to be treated, wherein each of the rubbing parts comprises:

a pair of first rubbing parts that is reciprocated in a side surface direction along a side surface of the body part to be treated, a pair of second rubbing parts that is reciprocated in a back surface direction along a back surface of the body part to be treated and in a direction perpendicular to the back surface direction, and a restriction part that restricts a movement of the rubbing part in a direction perpendicular to the side surface of the body part to be treated, wherein each of the rubbing parts are reciprocated linearly and parallel with respect to each other in mutually different phases.

2. The massage machine according to claim 1, wherein the first rubbing part and the second rubbing part are integrally configured.

3. The massage machine according to claim 1, wherein the pair of second rubbing parts is reciprocated in mutually different phases.

4. The massage machine according to claim 1, further comprising:

a base part which supports the rubbing unit, wherein the base part includes the restriction part.

5. A massage machine comprising:

a rubbing unit including a rubbing part that can perform rubbing massage on a body part of a person to be treated, wherein the rubbing part comprises:

a pair of external rubbing parts, and an intermediate rubbing part arranged between the pair of the external rubbing parts, wherein each of the external rubbing parts and the intermediate rubbing part include a first rubbing part that is reciprocated in a side surface direction along a side surface of the body part to be treated, and a second rubbing part that is reciprocated in a back surface direction along a back surface of the body part to be treated and in a direction perpendicular to the back surface direction, wherein the external rubbing parts and the intermediate rubbing part are reciprocated linearly and parallel with respect to each other in mutually different phases.

6. The massage machine according to claim 5, wherein the first rubbing part and the second rubbing part are integrally configured.

7. The massage machine according to claim 1, wherein each of the first rubbing parts includes a massage part which is arranged in the inner surface of the first rubbing part to perform a massage.

8. The massage machine according to claim 7, wherein the massage part is an air cell which expands and contracts by supply and discharge of air.

9. The massage machine according to claim 8, wherein the air cell expands and contracts during reciprocation of the rubbing part.

10. The massage machine according to claim 8, wherein the air cell is one of a plurality of air cells provided in the inner surface of the first rubbing part in a direction along the body part to be treated.

11. The massage machine according to claim 5, wherein the first rubbing part includes a massage part which is arranged in the inner surface of the first rubbing part to perform a massage.

12. The massage machine according to claim 11, wherein the massage part is an air cell which expands and contracts by supply and discharge of air.

13. The massage machine according to claim 12, wherein the air cell expands and contracts during reciprocation of the rubbing part.

14. The massage machine according to claim 12, wherein the air cell is one of a plurality of air cells provided in the inner surface of the first rubbing part in a direction along the body part to be treated.

15. The massage machine according to claim 5, further comprising:

a base part which supports the rubbing unit, wherein the base part includes a restriction part which restricts movement of the rubbing part in a direction perpendicular to the side surface of the body part to be treated.

* * * * *